US007357157B2

(12) United States Patent
Ueda

(10) Patent No.: US 7,357,157 B2
(45) Date of Patent: Apr. 15, 2008

(54) INDUSTRIAL TWO-LAYER FABRIC

(75) Inventor: Ikuo Ueda, Shizuoka (JP)

(73) Assignee: Nippon Filcon Co., Ltd., Tokyo (JP)

( * ) Notice: Subject to any disclaimer, the term of this patent is extended or adjusted under 35 U.S.C. 154(b) by 0 days.

(21) Appl. No.: 11/451,560

(22) Filed: Jun. 13, 2006

(65) Prior Publication Data

US 2006/0278297 A1 Dec. 14, 2006

(30) Foreign Application Priority Data

Jun. 14, 2005 (JP) ..... 2005-173469

(51) Int. Cl.
*D21F 7/08* (2006.01)
*D03D 25/00* (2006.01)

(52) U.S. Cl. ..... 139/383 A; 162/358.2; 162/903

(58) Field of Classification Search ..... 139/383 A; 162/348, 358.2, 900, 903
See application file for complete search history.

(56) References Cited

U.S. PATENT DOCUMENTS

| | | | | |
|---|---|---|---|---|
| 4,564,051 | A * | 1/1986 | Odenthal | 139/425 A |
| 4,815,503 | A * | 3/1989 | Borel | 139/383 A |
| 5,454,405 | A | 10/1995 | Hawes et al. | |
| 5,894,867 | A * | 4/1999 | Ward et al. | 139/383 A |
| 5,899,240 | A * | 5/1999 | Wilson | 139/383 A |
| 5,937,914 | A * | 8/1999 | Wilson | 139/383 A |
| 6,073,661 | A * | 6/2000 | Wilson | 139/383 A |
| 6,145,550 | A * | 11/2000 | Ward | 139/383 A |
| 6,179,013 | B1 * | 1/2001 | Gulya | 139/383 A |
| 6,354,335 | B1 | 3/2002 | Taipale et al. | |
| 6,581,645 | B1 * | 6/2003 | Johnson et al. | 139/383 A |
| 6,585,006 | B1 * | 7/2003 | Wilson et al. | 139/383 A |
| 6,745,797 | B2 * | 6/2004 | Troughton | 139/383 A |
| 6,810,917 | B2 * | 11/2004 | Stone | 139/383 A |
| 6,827,821 | B2 * | 12/2004 | Brewster et al. | 162/358.2 |
| 6,837,275 | B2 * | 1/2005 | Josef et al. | 139/383 A |
| 6,837,277 | B2 * | 1/2005 | Troughton et al. | 139/383 A |
| 6,860,969 | B2 * | 3/2005 | Troughton | 162/348 |
| 6,896,009 | B2 * | 5/2005 | Ward | 139/383 A |

(Continued)

FOREIGN PATENT DOCUMENTS

JP 2003-342889 A 12/2003

OTHER PUBLICATIONS

European Search Report, Sep. 19, 2006.

*Primary Examiner*—Robert H. Muromoto
(74) *Attorney, Agent, or Firm*—Rader, Fishman & Grauer, PLLC

(57) ABSTRACT

In a repeating unit of a two-layer fabric, a first upper surface side warp forms a first upper surface side warp design. A second upper surface side warp forms a latent portion in which the second upper surface side warp passes between the two layers of the fabric. A first lower warp binding yarn and a second lower warp binding yarn form first and second knuckles respectively by passing over one or two upper surface side wefts at a position not adjacent to two knuckles of the second upper surface side warp in the latent portion. The first and second knuckles are formed at different positions. The first lower warp binding yarn, second upper surface side warp and second lower warp binding yarn cooperatively form a second upper surface side warp design similar to the first upper surface side warp design.

10 Claims, 13 Drawing Sheets

U.S. PATENT DOCUMENTS 6,904,942 B2 * 6/2005 Odenthal ..... 139/383 A
6,953,065 B2 * 10/2005 Martin et al. ..... 139/383 A
6,959,737 B2 * 11/2005 Ward ..... 139/383 A
6,978,809 B2 * 12/2005 Quigley ..... 139/383 A
7,048,830 B2 * 5/2006 Heger et al. ..... 162/348
7,059,357 B2 * 6/2006 Ward ..... 139/348
7,059,359 B2 * 6/2006 Quigley et al. ..... 139/383 A
7,059,361 B1 * 6/2006 Hansson ..... 139/383 A
7,195,040 B2 * 3/2007 Ward ..... 139/383 A
7,216,677 B2 * 5/2007 Fujisawa ..... 139/383 A
7,219,701 B2 * 5/2007 Ward ..... 139/383 A
7,243,687 B2 * 7/2007 Barratte ..... 139/383 A
2003/0010393 A1 1/2003 Kuji
2003/0178087 A1 9/2003 Odenthal
2003/0217782 A1 11/2003 Nagura et al.
2004/0089365 A1 5/2004 Heger et al.

* cited by examiner

INDUSTRIAL TWO-LAYER FABRIC

TECHNICAL FIELD

The present invention relates to an industrial two-layer fabric having excellent breathability, surface property and fabric rigidity.

BACKGROUND ART

Fabrics woven with warps and wefts have conventionally been used widely as an industrial fabric. They are used in various fields including papermaking wires, conveyor belts and filter cloths and required to have fabric properties suited for the intended use or using environment. Of such fabrics, a papermaking wire used in a papermaking step for removing water from raw materials by making use of the meshes of a fabric must satisfy severe requirements. There is therefore a demand for the development of fabrics which do not transfer a wire mark of the fabric to paper and therefore have an excellent surface property, have a dehydration property for sufficiently removing unnecessary water contained in the raw materials, have enough abrasion resistance and rigidity to permit desirable use even under severe environments, and are capable of maintaining conditions necessary for making good-quality paper for a long period of time. In addition, fiber supporting property, improvement in a papermaking yield, dimensional stability and running stability are required. In recent years, owing to the speed-up of a papermaking machine, requirements for papermaking wires become severe further.

Since most of the requirements for industrial fabrics and how to satisfy them can be understood by describing a papermaking fabric on which the most strict requirement is imposed among industrial fabrics, the present invention will hereinafter be described using the papermaking fabric as a representative example.

For papermaking fabrics, excellent surface property not permitting transfer of wire marks of the fabric to paper, dehydration property for sufficiently removing unnecessary water contained in the raw materials, fiber supporting property for supporting fine fibers, and rigidity permitting long-period running even under severe running conditions are very important. Research on the design or constitution of a fabric capable of satisfying the above-described properties is proceeding. Recently, two-layer fabrics using, as a portion of upper surface side warps or lower surface side warps which are vertically arranged pairs, a warp binding yarn have been employed. The warp binding yarn is woven with both an upper surface side weft and a lower surface side weft and has a binding function. At the same time, it has a function similar to that of upper surface side warp or lower surface side warp constituting a portion of the upper side surface or lower side surface.

A two-layer fabric using a warp binding yarn is disclosed in Japanese Patent Laid-Open No. 2003-342889. This fabric has excellent surface property, because it uses a warp binding yarn and therefore does not use an additional binding yarn which destroys the upper surface side fabric design. In addition, it is superior in binding strength to a weft-bound fabric. In the fabric disclosed in this document, however, two warp binding yarns forming a pair pull an upper surface side weft to the lower side at a position where they pass over an upper surface side weft, resulting in the formation of a depressed portion on the upper side surface. A height difference therefore occurs between a knuckle formed by passing of an upper surface side warp, which is not involved in binding, over an upper surface side weft and a knuckle formed by passing of a warp binding yarn over an upper surface side weft and this sometimes remains as a mark on paper. In addition, warp binding yarns forming a pair adjacently cross each other in the fabric layer so that they may block an internal space in the layer and partially cause insufficient dehydration.

Thus, fabrics using a warp binding yarn and capable of satisfying all the properties that an industrial fabric is required to have such as dehydration property, surface property and rigidity have not yet been developed.

SUMMARY OF THE INVENTION

An object of the present invention is to provide an industrial two-layer fabric capable of satisfying all the properties that an industrial fabric must have such as dehydration property, surface property and rigidity.

The present invention relates to a two-layer fabric comprising a first upper surface side warp to be woven with an upper surface side weft, a first lower warp binding yarn to be woven with both an upper surface side weft and a lower surface side weft, a second upper surface side warp to be woven with an upper surface side weft and a second lower warp binding yarn to be woven with both an upper surface side weft and lower surface side weft. The first upper surface side warp and the first lower warp binding yarn form a pair of first binding warps. The second upper surface side warp and the second lower warp binding yarn form a pair of second binding warps. The pair of first binding warps and the pair of second binding warps are arranged adjacent to each other.

The first upper surface side warp, the first lower warp binding yarn, the second upper surface side warp and the second lower warp binding yarn are arranged in the following manner:

(1) The first upper surface side warp and the second upper surface side warp have different designs respectively and the second upper surface side warp forms a latent portion in which the second upper surface side warp passes between at least three upper surface side wefts and lower surface side wefts between two knuckles, which are formed by the second upper surface side warp that passes over the upper surface side weft;

(2) The second lower warp binding yarn passes over one or two upper surface side wefts at a position not adjacent to the knuckle of the second upper surface side warp in the latent portion and the first lower warp binding yarn also passes over one or two upper surface side wefts different from the upper surface side weft over which the second lower warp binding yarn passes at a position not adjacent to the knuckle of the second upper surface side warp in the latent portion; and (3) The first lower warp binding yarn and the second lower warp binding yarn get together with the second upper surface side warp therebetween and cooperatively form an upper surface side warp design similar to that of the first upper surface side warp on the upper surface side surface.

In the latent portion formed by the second upper surface side warp, both the first lower warp binding yarn and the second lower warp binding yarn may form respective knuckles passing over one or two different upper surface side wefts at a position not adjacent to the knuckle of the second upper surface side warp.

The second upper surface side warp may have a design of forming a plurality of latent portions. In this case, the first lower warp binding yarn may pass over one or two different upper surface side wefts to form a knuckle at a position not adjacent to the knuckle of the second upper surface side warp in one of the plurality of latent portions, while in another latent portion, the second lower warp binding yarn may pass over one or two different upper surface side wefts to form a knuckle at a position not adjacent to the knuckle of the second upper surface side warp.

A pair of warps composed of an upper surface side warp to be woven with an upper surface side weft and a lower surface side warp to be woven with a lower surface side weft may be arranged adjacent to the pairs of first binding warps and second binding warps. Further, the first lower warp binding yarn and the second lower warp binding yarn may have respectively different designs. Alternatively, the first lower warp binding yarn and the second lower warp binding yarn may have the same design or mirror-image designs which are left-right reversal each other.

An upper surface side warp design formed on the upper side surface cooperatively by the second upper surface side warp, the first lower warp binding yarn and the second lower warp binding yarn and the design of the first upper surface side warp may be each a 1/4-1/2 design in which a yarn passes over an upper surface side weft, passes under four successive upper surface side wefts, passes over an upper surface side weft and passes under two upper surface side wefts. Alternatively, an upper surface side warp design formed on the upper side surface cooperatively by the second upper surface side warp, the first lower warp binding yarn and the second lower warp binding yarn and the design of the first upper surface side warp may be each a 1/1 design in which a yarn passes over an upper surface side weft and passes under an upper surface side weft, and a plain weave design is thus formed on the upper side surface.

A lower surface side weft may pass over two successive lower surface side warps and/or lower warp binding yarns, and then pass under two or more successive lower surface side warps and/or lower warp binding yarns to form a long crimp of the lower surface side weft on the lower side surface. Alternatively, a lower surface side weft may pass over a lower surface side warp and/or lower warp binding yarn, and then pass under two or more successive lower surface side warps and/or lower warp binding yarns to form a long crimp of the lower surface side weft on the lower side surface.

The term "latent portion" as used herein means a portion of a second upper surface side warp passing between upper surface side wefts and lower surface side wefts. In this latent portion, the second upper surface side warp passes between an upper layer and a lower layer so that it appears neither from the upper side surface nor the lower side surface.

The industrial two-layer fabric of the present invention is obtained by using an upper surface side warp and two lower warp binding yarns in combination to form a design, on the upper side surface, similar to that formed by an upper surface side warp adjacent to the combination of them. Owing to a uniform design and uniform knuckle height, the fabric has excellent surface property. In addition, compared with conventional fabrics, it has many spaces in a diagonal direction in the fabric layer so that it has excellent breathability and water drainage property.

Figure 1:
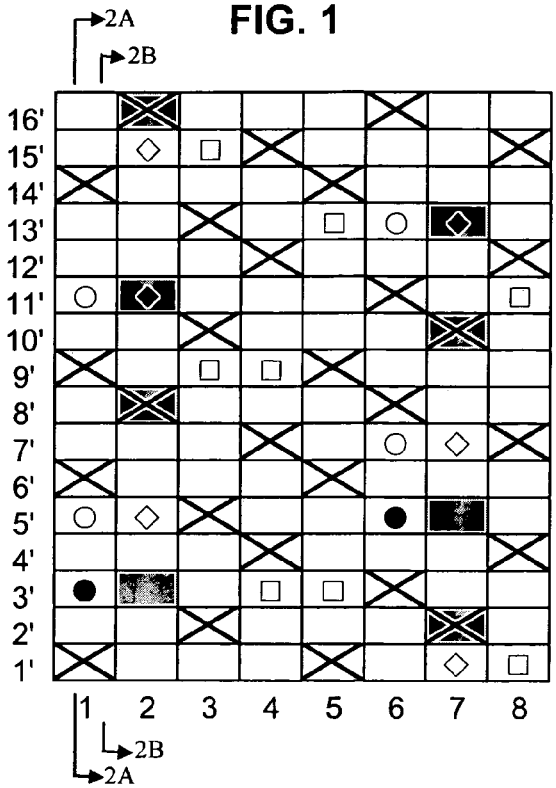
FIG. 1 is a design diagram showing a repeating unit of an industrial two-layer fabric of Example 1 according to the present invention.

Roman numerals 1, 2, 3 . . . 10 denote pairs of binding warps or pairs of warps. Roman numerals 1' to 20' denote upper surface side wefts, lower surface side wefts

DETAILED DESCRIPTION OF THE INVENTION

The industrial fabric of the present invention is a two-layer fabric comprising a first upper surface side warp to be woven with an upper surface side weft, a first lower warp binding yarn to be woven with both an upper surface side weft and lower surface side weft, a second upper surface side warp to be woven with an upper surface side weft and a second lower warp binding yarn to be woven with both an upper surface side weft and lower surface side weft, characterized in that the first upper surface side warp and the first lower warp binding yarn form a pair of first binding warps, the second upper surface side warp and the second lower warp binding yarn form a pair of second binding warps, the pair of first binding warps and the pair of second binding warps are arranged adjacent to each other and the first upper surface side warp, the first lower warp binding yarn, the second upper surface side warp and the second lower warp binding yarn are arranged in the above-mentioned order; the first upper surface side warp and the second upper surface side warp have respectively different designs and the second upper surface side warp has a design of forming a latent portion in which the second upper surface side warp passes between at least three upper surface side wefts and lower surface side wefts between two knuckles which the second upper surface side warp forms by passing over an upper surface side weft; the second lower warp binding yarn passes over one or two upper surface side wefts at a position not adjacent to the knuckle of the second upper surface side warp in the latent portion and the first lower warp binding yarn also passes over one or two upper surface side wefts different from the upper surface side weft over which the second lower warp binding yarn passes at a position not adjacent to the knuckle of the second upper surface side warp in the latent portion; and the first lower warp binding yarn and the second lower warp binding yarn get together with the second upper surface side warp therebetween and these three cooperatively form a similar upper surface side warp design to that of the first upper surface side warp on the upper surface side surface. The term "knuckle" as used herein means a winded and protruded portion formed by passing of an upper surface side warp, a warp binding yarn or a lower surface side warp over or under one or two wefts to interweave therewith and it is formed over an upper surface side weft or under a lower surface side weft.

In the fabric according to the present invention, upper and lower fabric layers can be woven strongly by a warp direction yarn without destroying the design on the upper side surface. The conventional fabric has problems in breathability and drainage property because two adjacent warp binding yarns are crossed each other to block the space inside of the fabric. The fabric of the present invention, on the other hand, is excellent in water drainage property and breathability because two warp binding yarns having an upper surface side warp sandwiched therebetween cooperatively form an upper surface side design so that a diagonal space appears between these three warps.

The fabric of the present invention comprises a pair of first binding warps composed of a first upper surface side warp and a first lower warp binding yarn and a pair of second binding warps composed of a second upper surface side warp and a second lower warp binding yarn and these pairs are disposed adjacent to each other. In addition to these pairs of first and second binding warps, a pair of warps composed of an upper surface side warp to be woven with an upper surface side weft and a lower surface side warp to be woven with a lower surface side weft may be disposed. A pair of binding warps is necessary for weaving upper and lower layers. At least one pair of first binding warps and at least one pair of second binding warps are necessary and all the pairs except them may be composed of warps. An increase in the number of the pairs of binding warps improves binding strength, but no problem occurs when at least one pair of first binding warps and at least one pair of second binding warps are disposed in each complete design of the fabric. For example, in each complete design of the fabric, two pairs of warps may be placed adjacent to the pairs of first and second binding warps; adjacent to the two pairs of warps, pairs of first and second binding warps may be disposed; and then two pairs of warps may be placed adjacent thereto.

The term "upper surface side warp" as used herein means a warp to be woven with an upper surface side weft to form an upper side surface design, while the term "lower warp binding yarn" means a yarn to be woven with an upper surface side weft and a lower surface side weft to form both the upper side surface design and lower side surface design. A lower warp binding yarn also functions as a binding yarn for weaving upper and lower layers. Since a yarn in a warp direction, which is a direction upon use of the fabric, is used for binding, the fabric is used always under tension so that no internal wear owing to loosening of the yarn occurs. Compared with an additional binding yarn used only for binding, a warp binding yarn does not generate an additional mark because it functions as a warp forming a surface. Moreover, the fabric also has excellent fiber supporting property because the absence of additional binding yarns leads to an increase in the shooting number.

The fabric of the present invention has a pair of first binding warps composed of a first upper surface side warp and a first lower warp binding yarn and a pair of second binding warps composed of a second upper surface side warp and a second lower warp binding yarn. They are disposed adjacent to each other. The first upper surface side warp, the first lower warp binding yarn, the second upper surface side warp and the second lower warp binding yarn are arranged in the order as mentioned above. This arrangement order has a very important meaning: The first lower warp binding yarn, the second upper surface side warp and the second lower warp binding yarn function cooperatively as one warp. The first upper surface side warp forms a design independently so that it is placed at one end of these four yarns, followed by the first lower warp binding yarn, the second upper surface side warp and the second lower warp binding yarn in this order.

The sentence "the first lower warp binding yarn, the second upper surface side warp and the second lower warp binding yarn function cooperatively as one warp" suggests that three yarns, that is, the first lower warp binding yarn and the second lower warp binding yarn having the second upper surface side warp sandwiched therebetween form a substantially equal warp design to that of the first upper surface side warp. When warps having a plain weave design in which a warp alternately passes over and under a weft are arranged, these warps do not cooperatively serve as one warp as in the above-described three yarns in the present invention, and two adjacent warps arranged at equal intervals do not get together. In the present invention, on the other hand, the second upper surface side warp forms a latent portion in which it passes between at least three upper surface side wefts and lower surface side wefts. The first lower warp binding yarn and the second lower warp binding yarn adjacent to the second upper surface side warp on both sides thereof each passes over one or two upper surface side wefts at a position not adjacent to the knuckle formed by the second upper surface side warp so that they get together with the second upper surface side warp therebetween. When in the latent portion, the first lower warp binding yarn or the second lower warp binding yarn passes over an upper surface side weft adjacent to the knuckle of the second upper surface side warp or over an upper surface side weft over which the second upper surface side warp forms a knuckle, these knuckles act repulsively and are separated each other owing to a difference in the height of knuckles or action of another force. They therefore do not seem to be only one warp. As in the fabric of the present invention, on the other hand, lower warp binding yarns on both sides of the second upper surface side warp form knuckles in the latent portion having no knuckle of the second upper surface side warp, these three yarns get together without repulsion and the knuckles of the lower warp binding yarns and the knuckle of the second upper surface side warp are disposed almost on the same line. They therefore seem to be only one warp.

When the second upper surface side warp has a design of forming two latent portions, that is, a latent portion in which the second upper surface side warp passes between three upper surface side wefts and lower surface side wefts and another latent portion in which it passes between five upper surface side wefts and lower surface side wefts, the second lower warp binding yarn has, for example, a design of passing over an upper surface side weft at the center of the latent portion corresponding to three wefts; and the first lower warp binding yarn has, for example, a design of passing over the second and fourth upper surface side wefts, each from the end, in the latent portion corresponding to five wefts. When the second upper surface side warp has a design of forming a latent portion in which it passes between eight upper surface side wefts and lower surface side wefts, the first lower warp binding yarn has, for example, a design of passing over the third weft from the end and the second lower warp binding yarn has, for example, a design of passing over the sixth weft from the end. Thus, there is no particular limitation insofar as the first and second lower warp binding yarns have each a design of forming a knuckle at a position separated, at a distance corresponding to a warp, from the knuckle of the second upper surface side warp.

The first lower warp binding yarn and the second lower warp binding yarn each has a design of passing over one or two upper surface side wefts at a position not adjacent to the knuckle formed by the second upper surface side warp in order to prevent repulsion between the first and second lower warp binding yarns and the second upper surface side warp as much as possible. Preferably, the lower warp binding yarn forms a knuckle near the center of the latent portion of the second upper surface side warp. For example, when the second upper surface side warp forms a latent portion corresponding to five wefts, the first lower warp binding yarn or the second lower warp binding yarn having a design of passing over the first or fifth upper surface side weft from the end is not preferred. If such a design is employed, constituent yarns do not function as one warp on the upper side surface owing to mutual repulsion. By making use of this action, when the first lower warp binding yarn forms a knuckle over an upper surface side weft over which the first upper surface side warp forms a warp knuckle or an upper surface side weft right adjacent thereto, the first lower warp binding yarn approaches the second upper surface side warp more owing to the repulsion between the first upper surface side warp and the first lower warp binding yarn. As a result, a warp design of the first upper surface side warp and another warp design corresponding to one warp and composed of the first lower warp binding yarn, the second upper surface side warp and the second lower warp binding yarn are preferably arranged at substantially equal intervals. In the conventional fabric, a lower warp binding yarn pulls an upper surface side weft to the lower side at a position where it passes over the weft so that there appears a portion depressed from another warp knuckle. In the present invention, on the other hand, the first and second lower warp binding yarns pass over an upper surface side weft in the latent portion of the second upper surface side warp so that even if the lower warp binding yarn weaves the upper surface side weft from the upper side, the second upper surface side warp lifts up the weft from the lower side and prevents depression of the binding portion. In short, since warp knuckles have substantially a uniform height, the resulting fabric has an excellent surface property.

No particular limitation is imposed on the design formed on the upper side surface. The design is, for example, a 1/4-1/2 design in which a warp passes over an upper surface side weft, passes under four successive upper surface side wefts, passes over an upper surface side weft and passes under two upper surface side wefts. The first upper surface side warp constitutes this design all by itself, but three yarns, that is, the first lower warp binding yarn, the second upper surface side warp and the second lower warp binding yarn must constitute this upper surface side design in cooperation so that the design of each yarn must be considered fully. Several kinds of weft designs can be given, depending on the shift of this warp design. For example, a 4/1-2/1 design in which a weft passes over four warps, passes under a warp, passes over two warps and passes under a warp or a 3/1 design in which a weft passes over three warps and then passes under a warp can be employed, depending on the shift of a warp having a 1/4-1/2 design.

On the upper side surface, a plain weave design may be formed by using 1/1 designs in which a warp passes over an upper surface side weft and then passes under an upper surface side weft in combination. Similarly, it is necessary to investigate the design of each constituent yarn, particularly, that of the first lower warp binding yarn, the second upper surface side warp and the second lower warp binding yarn.

No particular limitation is imposed on the lower side surface design. For example, preferred is a design in which a lower surface side weft passes over two successive lower surface side warps and/or lower warp binding yarns and then passes under two or more successive lower surface side warps and/or lower warp binding yarns to form a long crimp of the lower surface side weft on the lower side surface. By employing a design in which two adjacent warps on the lower surface side simultaneously weave a lower surface side weft, the long crimp of a lower surface side weft protrudes more from the surface, which improves both abrasion resistance and rigidity. It is more preferred to employ zigzag arrangement in which two adjacent warps weave a lower surface side weft from the lower surface side, alternately approach right-hand and left-hand adjacent warps thereto at that position, and substantially snake their way.

An example of the zigzag arrangement will next be described. In the lower side layer where pairs of warps and pairs of binding warps are arranged as needed, a lower surface side weft is woven simultaneously by two warps adjacent to each other to form a long crimp. In other words, two warps on the lower surface side, which are adjacent to each other, simultaneously pass under the same lower surface side weft. Supposing that three adjacent warps on the lower surface side are first lower warp binding yarn, second lower warp binding yarn and lower surface side warp 3, the second lower warp binding yarn is, together with the first lower warp binding yarn adjacent thereto, woven by a lower surface side weft 1'. The second lower warp binding yarn is, together with the lower surface side warp 3 adjacent thereto, woven by a lower surface side weft 7'. Two warps on the lower side, which are adjacent to each other, approach and get together at a position where they are woven with a lower surface side weft. In other words, the first and second lower warp binding yarns get together at a position where there are woven with the lower surface side weft 1', while the second lower warp binding yarn and lower surface side warp 3 get together at a position where they were woven with the lower surface side weft 7'. The second lower warp binding yarn approaches on the side of the first lower warp binding yarn at the intersection with lower surface side weft 1' and approaches on the side of the lower surface side warp 3 at the intersection with the lower surface side weft 7'. Then, the second lower warp binding yarn travels from side to side and therefore exhibits zigzag arrangement. By a similar mechanism, other warps also exhibit zigzag arrangement. By this zigzag arrangement, the fabric has improved rigidity in the diagonal direction. Moreover, owing to existence of both an overlap portion and a non-overlap portion of a warp on the upper surface side with a warp on the lower surface side, meshes with a random size or shape can be formed and stepwise dehydration can be carried out. This makes it possible to prevent generation of dehydration marks, sticking of a sheet raw material onto a wire or loss of fiber or filler from the wire.

The design of each of the first lower warp binding yarn and the second lower warp binding yarn constituting the upper side surface design or lower side surface design may be selected as needed. They may have a same design or different design. In particular, it is preferred that the first lower warp binding yarn and the second lower warp binding yarn have the same design or mirror-image designs which are left-right reversal each other, because the pulling strength of an upper surface side weft toward the lower side becomes constant, making it possible to form, on the surface, knuckles uniform in height. Moreover, tension balance between them during weaving becomes almost equal, which contributes to elimination of the need for increasing the number of beams of a weaving machine.

No particular limitation is imposed on the arrangement ratio of upper surface side wefts and lower surface side wefts. It is preferred that in the papermaking fabric, the upper side surface is made dense from the standpoints of fiber supporting property and surface property and the lower side surface is made rough because wefts having a larger diameter are preferably used in order to improve abrasion resistance. For example, upper surface side wefts and lower surface side wefts are arranged at a ratio of 2:1, 4:3 or the like. They may of course be arranged at a ratio of 1:1.

On the upper side surface, auxiliary wefts smaller in diameter than upper surface side wefts may be placed between upper surface side wefts. For example, an upper surface side weft and an auxiliary weft are arranged alternately to form a long crimp of the auxiliary weft passing over a plurality of warps. Such a design is effective for improving the fiber supporting property of wefts.

Although no particular limitation is imposed on the diameter of constituent yarns, upper surface side wefts and upper surface side warps constituting the upper side surface preferably have a relatively smaller diameter in order to obtain a dense and smooth surface. For applications requiring a good surface property, use of lower warp binding yarns having an equal diameter to upper surface side warps is preferred. A difference in diameter between upper surface side warps and lower warp binding yarns is not preferred because yarns having a larger diameter may protrude from the upper side surface and give wire marks to paper. When upper surface side warps and lower warp binding yarns have the same diameter, warp knuckles on the upper side may have the same height, making it possible to form a relatively uniform surface. Lower warp binding yarns and lower surface side warps may have the same diameter when abrasion resistance is an important factor.

The lower side surface which will be brought into contact with a machine or roll requires rigidity and abrasion resistance so that lower surface side wefts and lower surface side warps have preferably a relatively large diameter.

Yarns to be used in the present invention may be selected depending on the using purpose. Examples of them include, in addition to monofilaments, multifilaments, spun yarns, finished yarns subjected to crimping or bulking such as so-called textured yarn, bulky yarn and stretch yarn, and yarns obtained by intertwining them. As the cross-section of the yarn, not only circular form but also square or short form such as stellar form, or elliptical or hollow form can be used. The material of the yarn can be selected freely and usable examples of it include polyester, polyamide, polyphenylene sulfide, polyvinylidene fluoride, polypropylene, aramid, polyether ether ketone, polyethylene naphthalate, polytetrafluoroethylene, cotton, wool and metal. Of course, yarns obtained using copolymers or incorporating or mixing the above-described material with a substance selected depending on the intended purpose may be used.

As upper surface side warps, lower surface side warps, lower warp binding yarns and upper surface side wefts of a paper making wire, polyester monofilaments having rigidity and excellent size stability are usually suited. As lower surface side wefts which require wear resistance, those obtained by interweaving a polyester monofilament and a polyamide filament, for example, by disposing them alternately are preferred because the fabric using such a weft has improved wear resistance while maintaining rigidity.

EXAMPLES

Referring to accompanying drawings, embodiments of the present invention will next be described based on some Examples.

Figure 3:
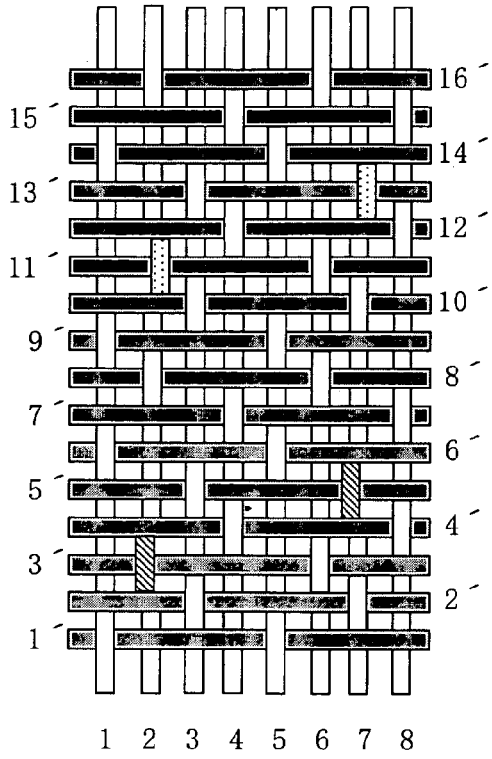
FIG. 3 is a plain view illustrating the upper side surface of FIG. 1.

FIGS. 1 to 27 illustrate examples of the present invention and they are design diagrams and cross-sectional views taken along warps. FIG. 3 illustrates the surface on the upper side of the fabric of Example 1.

A design diagram is a minimum repeating unit of a fabric design and a whole fabric design is formed by connecting this complete design longitudinally and latitudinally. In the design diagram, warps are indicated by Arabic numerals, for example 1, 2 and 3, of which some are pairs of warps composed of upper surface side warp and lower surface side warp and some are pairs of binding warps composed of upper surface side warp and lower warp binding yarn. Wefts are indicated by Arabic numerals with a prime, for example, 1', 2' and 3'. In particular, upper surface side wefts are indicated by attaching "u" to the Arabic numerals with a prime, for example, 1'*u*, 2'*u* and 3'*u*, while lower surface side wefts are indicated by attaching "d", for example 1'*d*, 2'*d* and 3'*d*. Some of them have an upper surface side weft and a lower surface side weft stacked vertically and some are composed only of an upper surface side weft, which is determined depending on the arrangement ratio.

In these diagrams, a mark "×" means that an upper surface side warp lies over an upper surface side weft; a mark "□" indicates that a lower surface side warp lies under a lower surface side weft; a mark "●" indicates that a first lower warp binding yarn lies over an upper surface side weft; a mark "○" indicates that a first lower warp binding yarn lies under a lower surface side weft; a mark "◆" indicates that a second lower warp binding yarn lies over an upper surface side weft; and a mark "◇" indicates that a second lower warp binding yarn lies under a lower surface side weft. In the cross-sectional view of warps, a yarn filled with diagonal lines is a first lower warp binding yarn, while a yarn filled with dots is a second lower warp binding yarn.

In the design diagram, yarns are vertically overlapped precisely. They are however illustrated as such for convenience of drawing and misalignment is allowed in the actual fabric. With regards to wefts, some upper surface side wefts do not have a lower surface side weft thereunder because of the arrangement ratio. A first lower warp binding yarn, second upper surface side warp and second lower warp binding yarn mutually get together to function as one warp constituting an upper side complete design on the upper side surface. In the cross-sectional view of binding warps, a first lower warp binding yarn, second upper surface side warp and second lower warp binding yarn cooperatively form the same design as a first upper surface side warp so that the first upper surface side warp and the other three warps are illustrated separately.

Example 1

Figure 2A:
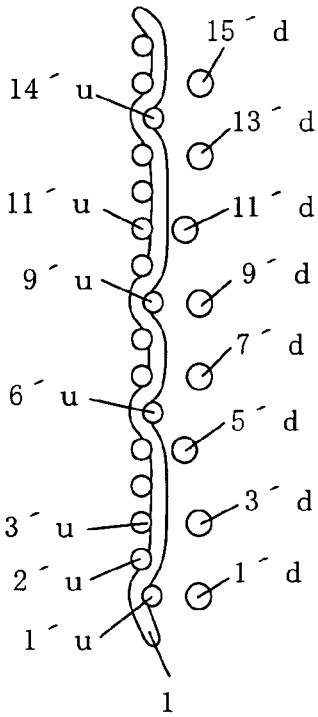
FIGS. 2A and 2B include cross-sectional views taken along the lines 2A-2A and 2B-2B of FIG. 1 showing a pair 1 of first binding warps and a pair 2 of second binding warps in FIG. 1 respectively.
Figure 2B:
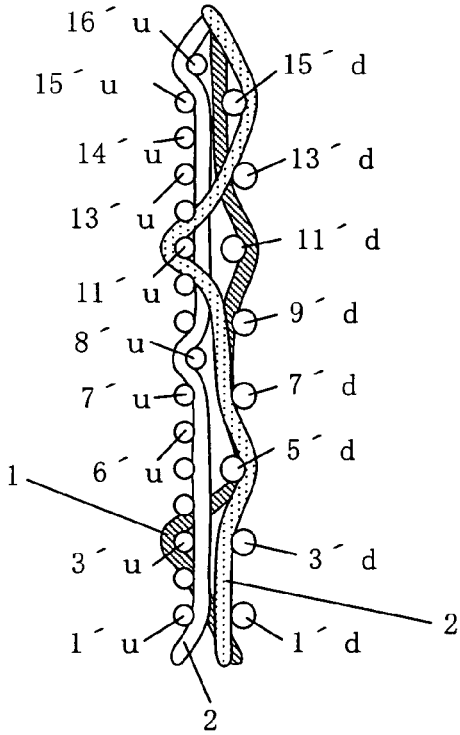

FIG. 1 is a design diagram showing a repeating unit of a fabric of Example 1 of the present invention. FIGS. 2A and 2B include cross-sectional views along the lines 2A-2A and 2B-2B of FIG. 1 which represent a first pair of first upper surface side warp 1 (FIG. 2A) and first lower warp binding yarn 1 (FIG. 2B), and a second pair of second upper surface side warp 2 and second lower warp binding yarn 2 (FIG. 2B) illustrated in the design diagram of FIG. 1 respectively. FIG. 3 is a plan view illustrating the upper side surface illustrated in the design diagram of FIG. 1. The fabric of this example is a two-layer 16-shaft fabric in which pairs of binding warps are arranged at a ratio of 4/8, while upper surface side wefts and lower surface side wefts are arranged at a ratio of 2:1.

In the design diagram of FIG. 1, indicated at numerals 1 and 6 are each a pair of first binding warps, 2 and 7 are each a pair of second binding warp, and 3, 4, 5 and 8 are each a pair of warps composed of an upper surface side warp and a lower surface side warp. Lower warp binding yarns for weaving upper and lower layers are arranged at a ratio of 4/16 and even at such a ratio, a sufficient binding strength can be attained.

On the upper side surface, warps have a 1/4-1/2 design in the repeating unit in which a warp passes over one upper surface side weft, passes under four successive upper surface side wefts, passes over another upper surface side weft and passes under another two upper surface side wefts, while upper surface side wefts have a design in which each weft passes over one upper surface side warp or lower warp binding yarn and then passes under three upper surface side warps and/or lower warp binding yarns. Described specifically, on the upper side surface as illustrated in FIG. 2A, a design in which the first upper surface side warp 1 passes over an upper surface side weft 1'*u*, passes under four successive upper surface side wefts 2'*u*, 3'*u*, 4'*u* and 5'*u*, passes over an upper surface side weft 6'*u*, passes under two upper surface side wefts 7'*u* and 8'*u*, passes over an upper surface side weft 9'*u*, passes under four successive upper surface side wefts 10'*u*, 11'*u*, 12'*u*, and 13'*u*, passes over an upper surface side weft 14'*u* and passes under two upper surface wide wefts 15'*u* and 16'*u* appears in repetition. On the upper side surface, as illustrated in FIGS. 2B and 3, the first lower warp binding yarn 1 (illustrated with hatched gray shading), the second upper surface side warp 2 and the second lower warp binding yarn 2 (illustrated with dotted gray shading) form, in cooperation, a 1/4-1/2 design similar to that of the first upper surface side warp 1. Each or any two of the first lower warp binding yarn 1, the second upper surface side warp 2 and the second lower warp binding yarn 2 do not form a design similar to that of the first upper surface side warp, but these three form an upper side warp design in cooperation. The upper surface side warp 1, the lower warp binding yarn 1, the second upper surface side warp 2 and the second lower warp binding yarn 2 are arranged in the order as mentioned above. The first lower warp binding yarn 1 (hutched shading is applied in FIGS. 2B and 3), the second upper surface side warp 2 and the second lower warp binding yarn 2 (dotted shading is applied in FIGS. 2B and 3) form an upper side warp design in cooperation so that they must be arranged in such an order.

Described specifically, the second upper surface side warp 2 has a design of forming latent portions in which the warp 2 passes between three or more successive upper surface side wefts and lower surface side wefts, that is, a latent portion in which the warp 2 passes between seven upper surface side wefts 1'*u* to 7'*u* and lower surface side wefts and another latent portion in which the warp 2 passes between seven upper surface side wefts 9'*u* to 15'*u* and lower surface side wefts. The first lower warp binding yarn 1 has a design in which the yarn 1 passes over an upper surface side weft 3'*u* at a position not adjacent to the knuckle of the second upper surface side warp 2 in one of the latent portions and the second lower warp binding yarn 2 has a design in which the yarn 2 passes over an upper surface side weft 11'*u* at a position not adjacent to the knuckle of the second upper surface side warp 2 in the other latent portion. In this manner, three yarns, that is, the second upper surface side warp 2 and the first lower warp binding yarn 1 and the second lower warp binding yarn 2 disposed on both sides with the second upper surface side warp 2 therebetween form a 1/4-1/2 design similar to that of the first upper surface side warp 1. Described specifically, a combination of the first lower warp binding yarn 1, second upper surface side warp 2 and second lower warp binding yarn 2 forms a 1/4-1/2 design in which any of the three yarns passes over an upper surface side weft 3', passes under four successive upper surface side wefts 4'*u*, 5'*u*, 6'*u* and 7'*u*, passes over an upper surface side weft 8'*u*, passes under two upper surface side wefts 9'*u* and 10'*u*, passes over an upper surface side weft 11'*u*, passes over four successive upper surface side wefts 12'*u*, 13'*u*, 14'*u* and 15'*u*, passes over an upper surface side weft 16'*u*, and passes under two upper surface side wefts 1'*u* and 2'*u*.

In the present invention, the second upper surface side warp 2 has a design of forming latent portions in which it passes between three or more upper surface side wefts and lower surface side wefts. The first lower warp binding yarn 1 and the second lower warp binding yarn 2 adjacent to the second upper surface side warp 2 on both sides thereof pass, in the latent portions, over one or two upper surface side wefts at positions not adjacent to the knuckles formed by the second upper surface side warp 2 so that they get together with the second upper surface side warp 2 therebetween. When the lower warp binding yarn 1 or second lower warp binding yarn 2 passes over the same upper surface side weft over which the second upper surface side warp 2 passes or a weft adjacent thereto, a difference in height of knuckles or the action of another force causes repulsion and separation of these knuckles and they do not cooperatively serve as a warp. A design, as the fabric of the present invention, in which first and second lower warp binding yarns form knuckles at positions not adjacent to the knuckle of the second upper surface side warp 2 in the latent portions, they get together without repulsion and knuckles of warp binding yarns are arranged on almost the same line with that of the second upper surface side warp. They therefore seem to be only one warp.

At a binding portion in which a lower warp binding yarn passes over an upper surface side weft, the lower warp binding yarn tries to pull the upper surface side weft toward the lower side, but in the present invention, at this pulling portion, the second upper surface side warp 2 adjacent to the lower warp binding yarn supports the upper surface side weft by passing under the upper surface side weft so that there exists no depressed portion and the knuckles have a uniform height.

In addition, since an upper surface side warp to be woven only with an upper surface side weft is placed between lower warp binding yarns for weaving the upper and lower layers, a space appears between the lower warp binding yarns in a diagonal direction, which results in a fabric with excellent breathability and water drainage property. The pair 1 of first binding warps and the pair 2 of second binding warps were so far described, which will be equally applicable to the pair 6 of first binding yarns and pair 7 of second binding yarns.

On the lower side surface, warps on the lower side have a 4/1-2/1 design in which a warp passes over four lower surface side wefts, passes under a lower surface side weft, over two lower surface side wefts and passes under a lower surface side weft. Lower surface side wefts have a design in which each lower surface side weft passes over two adjacent warps on the lower surface side, and passes under six successive warps on the lower surface side, and thereby form a weft long crimp on the lower side surface. By employing this design having a weft long crimp formed on the lower side surface, the resulting fabric has excellent abrasion resistance. The lower surface side wefts are woven by two adjacent warps from the lower side and therefore have improved rigidity. In addition, they have excellent abrasion resistance owing to an increase in the volume of the abrasion resistant volume owing to a long crimp protruded from the lower side surface. Warps constituting the lower side surface each forms zigzag arrangement by alternately approaching right-hand and left-hand warps adjacent thereto at a portion where it weaves a lower surface side weft from the lower surface side. The term "zigzag arrangement" means a structure in which a warp on the lower surface side forms a knuckle under a lower surface side weft under which a right-hand warp adjacent thereto on the lower surface side also forms a knuckle and then it forms a knuckle under a lower surface side weft under which a left-hand warp adjacent thereto on the lower surface side forms a knuckle, thus alternately approaching the right-hand warp and left-hand warp. By the zigzag arrangement, warps wind their way from side to side and the resulting fabric has improved rigidity in the diagonal direction. This permits mixed existence of an overlapped portion and non-overlapped portion of warps on the upper surface side and warps on the lower surface side and appearance of meshes not uniform in size or shape. This makes it possible to carry out stepwise dehydration and prevent generation of dehydration marks, sticking of a sheet raw material onto a wire and loss of fibers or fillers.

For example, a lower surface side warp 4, simultaneously with a lower surface side warp 5 which is adjacent thereto on the right hand side, forms a knuckle under a lower surface side weft 3'*d* and then forms, simultaneously with a lower surface side warp 3 which is adjacent to the warp 4 on the left hand side, another knuckle under a lower surface side weft 9'*d*. This brings the lower surface side warp 4 to the right side at the intersection with the lower surface side weft 3'*d* and to the left side at the intersection with the lower surface side weft 9'*d*. On the upper surface side surface, different from warps on the lower surface side, upper surface side warps and warp binding yarns do not have a design constituting zigzag arrangement so that upper and lower warps overlap with each other in some portions and they do not overlap in some portions. The dehydration holes penetrating from the upper side to the lower side do not have a uniform shape, making it possible to prevent partially rapid dehydration. Only the lower surface side warp 4 was so far described, but other lower surface side warps and warp binding yarns also adopt a similar random structure so that the resulting fabric as a whole can be equipped with a uniform surface property.

Example 2

Figure 4:
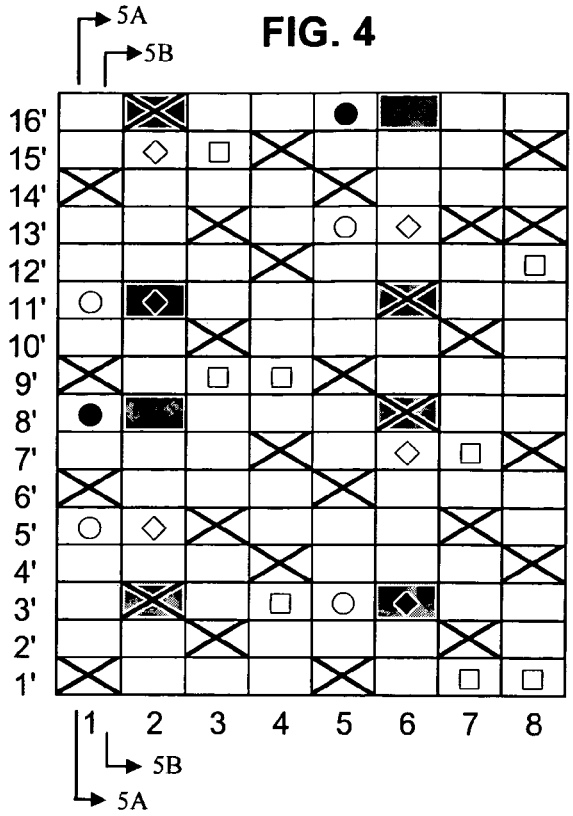
FIG. 4 is a design diagram showing a repeating unit of an industrial two-layer fabric of Example 2 according to the present invention.
Figure 5A:
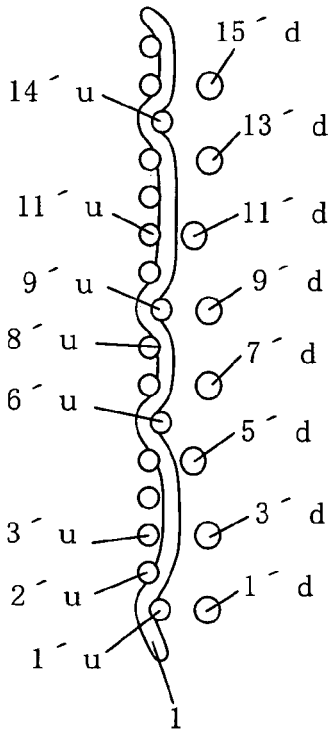
FIGS. 5A and 5B include cross-sectional views taken along the lines 5A-5A and 5B-5B of FIG. 4 showing pair 1 of first binding warps 1 and a pair 2 of second binding warps in FIG. 4 respectively.
Figure 5B:
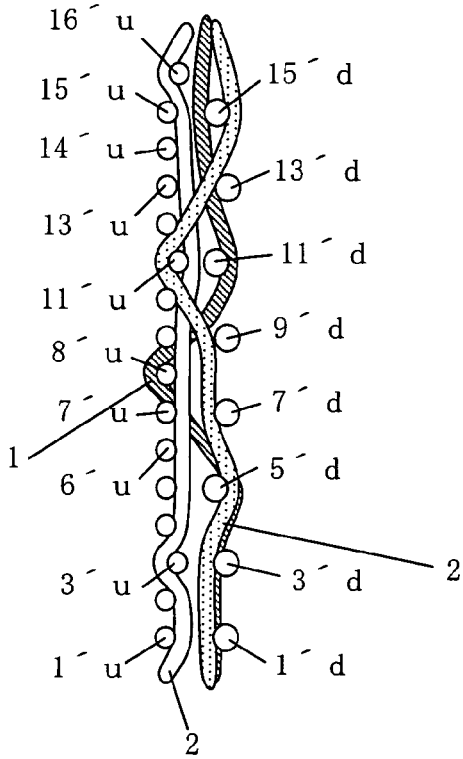

FIG. 4 is a design diagram showing a repeating unit of a fabric of Example 2 of the present invention. FIGS. 5A and 5B include cross-sectional views along lines 5A-5A and 5B-5B of FIG. 4 illustrating a first upper surface side warp 1 (FIG. 5A), and a first lower warp binding yarn 1 (FIG. 5B), a second upper surface side warp 2 and a second lower warp binding yarn 2 illustrated in the design diagram of FIG. 4.

In the design diagram of FIG. 4, indicated at numerals 1 and 5 are each a pair of first binding warps, 2 and 6 are each a pair of second binding warps, and 3, 4, 7 and 8 are each a pair of warps composed of an upper surface side warp and a lower surface side warp.

The upper side surface is, similar to Example 1, composed of warps having a 1/4-1/2 design and wefts having a 1/3 design. The first lower warp binding yarn 1, the second upper surface side warp 2 and the second lower warp binding yarn have respectively different designs, but the design formed by them in combination is a 1/4-1/2 design, which is not different from the design of the first upper surface side warp 1. The first upper surface side warp 1 is composed of repetition of a 1/4-1/2 design in which it passes over an upper surface side weft 1'*u*, passes under four successive upper surface side wefts 2'*u*, 3'*u*, 4'*u* and 5'*u*, passes over an upper surface side weft 6'*u*, passes under two upper surface side wefts 7'*u* and 8'*u*, passes over an upper surface side weft 9'*u*, passes under four successive upper surface side wefts 10'*u*, 11'*u*, 12'*u* and 13'*u*, passes over an upper surface side weft 14'*u*, and passes under two upper surface side wefts 15'*u* and 16'*u*. The first lower warp binding yarn 1, the second upper surface side warp 2 and the second lower warp binding yarn 2 form, in cooperation, the 1/4-1/2 design similar to that of the first upper surface side warp on the upper side surface. Each or any two of them do not form a design similar to that of the first upper surface side warp, but these three form an upper side warp design in cooperation.

The second upper surface side warp 2 has a design of forming a latent portion in which it passes between twelve upper surface side wefts 4'*u* to 15'*u* and lower surface side wefts. In the latent portion, the first lower warp binding yarn 1 has a design of passing over the upper surface side weft 8'*u* not adjacent to the knuckle of the second upper surface side warp 2 and the second lower warp binding yarn 2 has a design of passing over the upper surface side weft 11'*u* not adjacent to the knuckle of the second upper surface side warp 2. In this Example, two lower warp binding yarns form respective knuckles over upper surface side wefts not adjacent to the knuckle of the second upper surface side warp 2 in one long latent portion. By this design, the first warp binding yarn 1 and the second warp binding yarn 2 get together with the second upper surface side warp 2 sandwiched therebetween. When the first warp binding yarn 1 or second warp binding yarn 2 passes over the upper surface side weft over which the second upper surface side warp 2 also passes or a weft adjacent thereto, a difference in height between knuckles or action of another force causes repulsion and separation of these knuckles and these yarns do not cooperatively serve as a warp. A design, as the fabric of the present invention, in which lower warp binding yarns on both sides of the second upper surface side warp form knuckles in the latent portion in which no knuckle of the second upper surface side warp 2 exists, they get together without repulsion and respective knuckles of the warp binding yarns and the knuckle of the second upper surface side warp are arranged on almost the same line. They therefore seem to be only one warp.

At a binding portion in which a lower warp binding yarn passes over an upper surface side weft, the lower warp binding yarn tries to pull the upper surface side weft toward the lower side, but in the present invention, at the pulling portion, the second upper surface side warp 2 adjacent to the lower warp binding yarn supports the upper surface side weft by passing under the upper surface side weft so that the knuckles have a uniform height without depressed portion.

In addition, since an upper surface side warp to be woven with only an upper surface side weft is placed between lower warp binding yarns for weaving the upper and lower layers, a space appears in a diagonal direction between lower warp binding yarns, which results in a fabric with excellent breathability and water drainage property. The pair 1 of first binding warps and the pair 2 of second binding warps were so far described, which will be equally applicable to the pair 6 of first binding yarns and pair 7 of second binding yarns.

The lower side surface has a similar design to that of Example 1 so that the fabric has excellent abrasion resistance, rigidity and rigidity in the diagonal direction of the fabric and generation of dehydration marks, sticking of a sheet raw material onto a wire, and loss of fibers or fillers can be prevented.

Example 3

Figure 6:
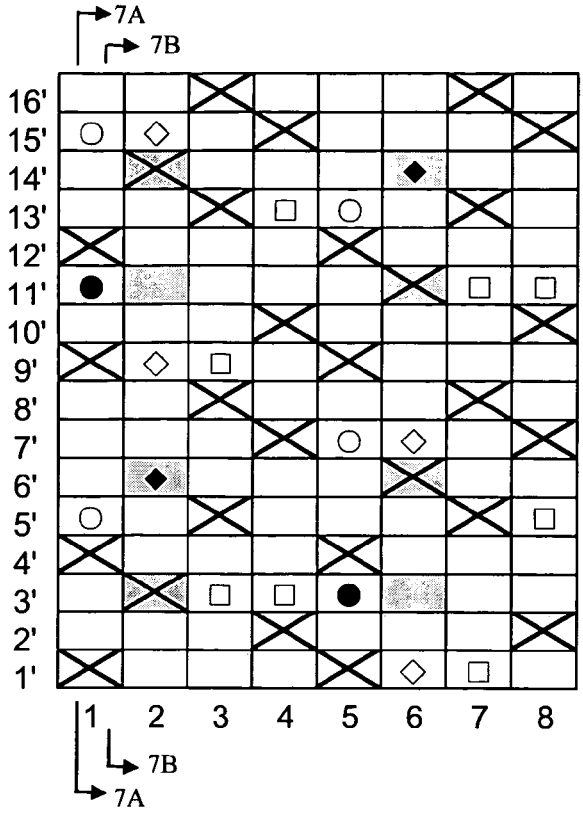
FIG. 6 is a design diagram showing a repeating unit of an industrial two-layer fabric of Example 3 according to the present invention.
Figure 7A:
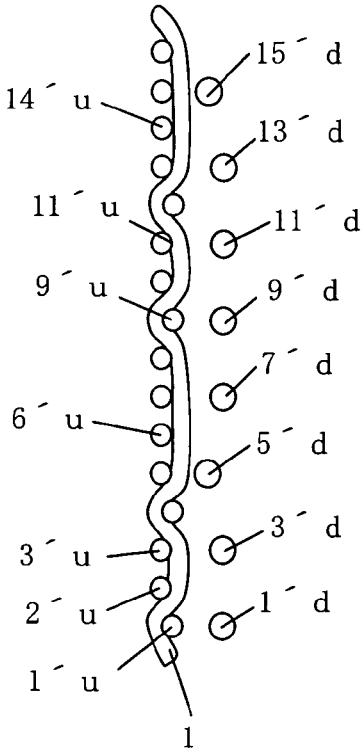
FIGS. 7A and 7B include cross-sectional views taken along the lines 7A-7A and 7B-7B of FIG. 6 showing a pair 1 showing first binding warps 1 and a pair 2 of second binding warps in FIG. 6 respectively.
Figure 7B:
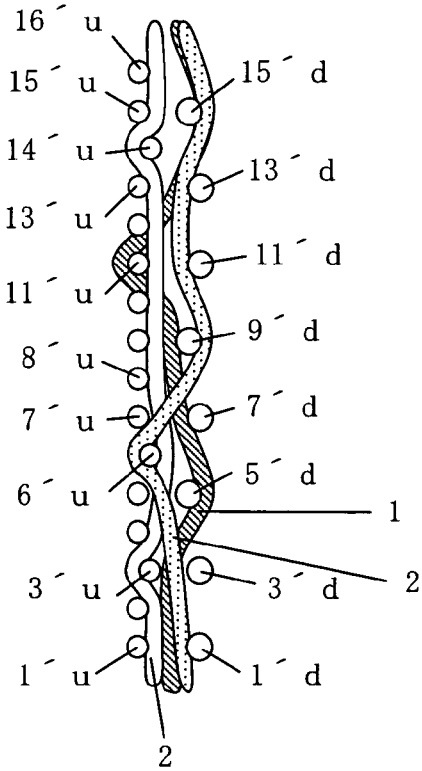

FIG. 6 is a design diagram showing a repeating unit of a fabric of Example 3 of the present invention. FIGS. 7A and 7B include cross-sectional views along the lines 7A-7A and 7B-7B of FIG. 6 illustrating a first upper surface side warp 1 (FIG. 7A), and a first lower warp binding yarn 1 (FIG. 7B), a second upper surface side warp 2 and a second lower warp binding yarn 2 (FIG. 7B) illustrated in the design diagram of FIG. 6 respectively.

In the design diagram of FIG. 6, indicated at numerals 1 and 5 are each a pair of first binding warps, 2 and 6 are each a pair of second binding warps, and 3, 4, 7 and 8 are each a pair of warps composed of an upper surface side warp and a lower surface side warp.

The upper side surface is, similar to Example 1, composed of warps having a 1/4-1/2 design and wefts having a 1/3 design. The first lower warp binding yarn 1, the second upper surface side warp 2 and the second lower warp binding yarn 2 have respectively different designs, but the design formed by them in combination is a 1/4-1/2 design, which is not different from the design of the first upper surface side warp 1.

The second upper surface side warp 2 has a design of forming a latent portion in which it passes between ten upper surface side wefts 4'*u* to 13'*u* and lower surface side wefts. In the latent portion, the first lower warp binding yarn 1 has a design of passing over the upper surface side weft 11'*u* and the second lower warp binding yarn 2 has a design of passing the upper surface side weft 6'*u*. In this Example, two lower warp binding yarns form knuckles over upper surface side wefts which are not adjacent to the knuckle of the second upper surface side warp 2 in the long latent portion. By this design, the first lower warp binding yarn 1, the second upper surface side warp 2 and the second lower warp binding yarn 2 get together without repulsion and the knuckles of lower warp binding yarns and the knuckle of the second upper surface side warp are arranged on almost the same line. They therefore seem to be only one warp.

At a binding portion in which a lower warp binding yarn passes over an upper surface side weft, the lower warp binding yarn tries to pull the upper surface side weft toward the lower side, but in the present invention, at the pulling portion, the second upper surface side warp 2 adjacent to the lower warp binding yarn supports the upper surface side weft from below by passing under the upper surface side weft so that the knuckles have a uniform height without depressed portion.

In addition, since an upper surface side warp to be woven only with an upper surface side weft is placed between lower warp binding yarns for weaving the upper and lower layers, a space appears in a diagonal direction between lower warp binding yarns, which results in a fabric with excellent breathability and water drainage property. The pair 1 of first binding warps and the pair 2 of second binding warps were so far described, which will be equally applicable to the pair 5 of first binding yarns and pair 6 of second binding yarns.

The lower side surface has a similar design to that of Example 1 so that the fabric has excellent abrasion resistance, rigidity and rigidity in the diagonal direction and generation of dehydration marks, sticking of a sheet raw material onto a wire, and loss of fibers or fillers can be prevented.

Example 4

Figure 8:
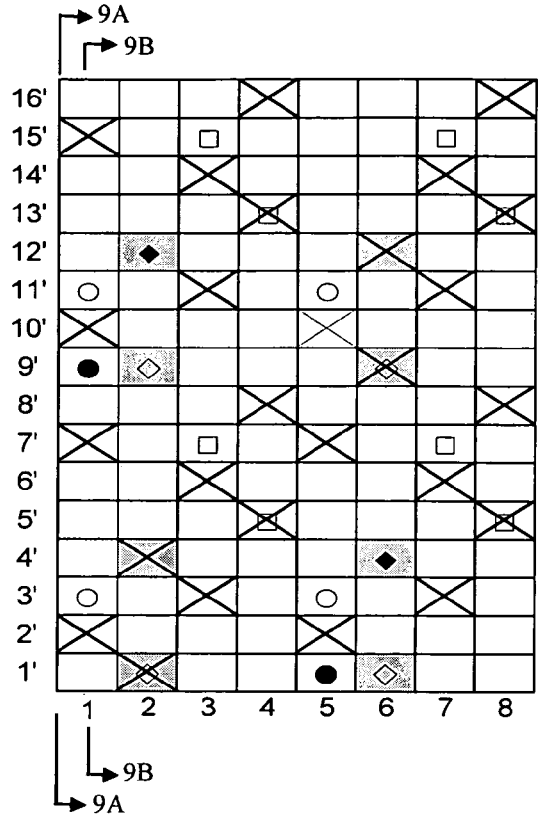
FIG. 8 is a design diagram showing a repeating unit of an industrial two-layer fabric of Example 4 according to the present invention.
Figure 9A:
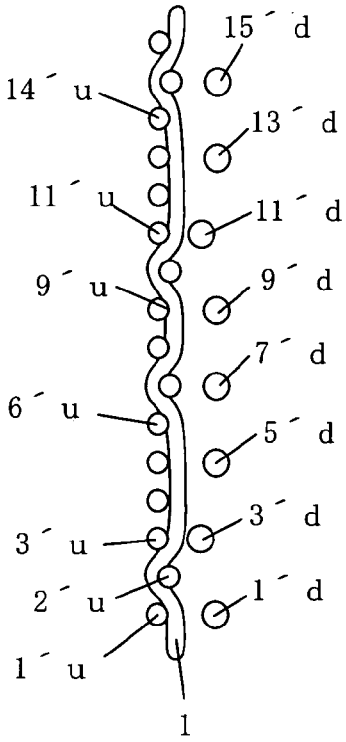
FIGS. 9A and 9B include cross-sectional views taken along the lines 9A-9A and 9B-9B of FIG. 8 of a pair 1 showing first binding warps 1 and a pair 2 of second binding warps in FIG. 8 respectively.
Figure 9B:
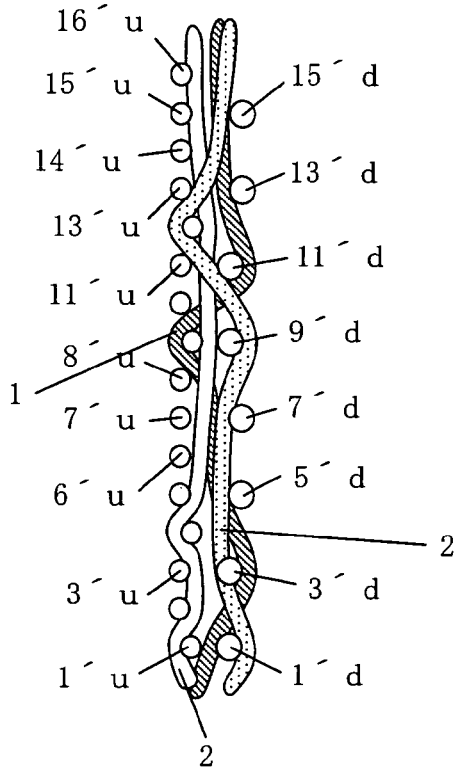

FIG. 8 is a design diagram showing a repeating unit of a fabric of Example 4 of the present invention. FIGS. 9A and 9B include cross-sectional views along the lines 9A-9A and 9B-9B of FIG. 8 illustrating a first upper surface side warp 1 (FIG. 9A), and a first lower warp binding yarn 1 (FIG. 9B), a second upper surface side warp 2 and a second lower warp binding yarn 2 (FIG. 9B) illustrated in the design diagram of FIG. 8.

In the design diagram of FIG. 8, indicated at numerals 1 and 5 are each a pair of first binding warps, 2 and 6 are each a pair of second binding warps, and 3, 4, 7 and 8 are each a pair of warps composed of an upper surface side warp and a lower surface side warp.

The upper side surface is, similar to Example 1, composed of warps having a 1/4-1/2 design and wefts having a 1/3 design. The first lower warp binding yarn 1, the second upper surface side warp 2 and the second lower warp binding yarn 2 have respectively different designs, but the design formed by them in combination is a 1/4-1/2 design, which is not different from the design of the first upper surface side warp 1.

The second upper surface side warp 2 has a design of forming a latent portion in which it passes between twelve upper surface side wefts 5'*u* to 16'*u* and lower surface side wefts. In the latent portion, the first lower warp binding yarn 1 has a design of passing over the upper surface side weft 9'*u* and the second lower warp binding yarn 2 has a design of passing over the upper surface side weft 12'*u*. In this Example, two lower warp binding yarns form respective knuckles over upper surface side wefts not adjacent to the knuckle of the second upper surface side warp 2 in the long latent portion. By this design, the first lower warp binding yarn 1, the second upper surface side warp 2 and the second lower warp binding yarn 2 get together without repulsion and knuckles of lower warp binding yarns and the knuckle of the second upper surface side warp are arranged on almost the same line. They therefore seem to be only one warp.

At a binding portion in which a lower warp binding yarn passes over an upper surface side weft, the lower warp binding yarn tries to pull the upper surface side weft toward the lower side, but in the present invention, at the pulling portion, the second upper surface side warp 2 adjacent to the lower warp binding yarn supports the upper surface side weft from below by passing under the upper surface side weft so that the knuckles have a uniform height without depressed portion.

In addition, since an upper surface side warp to be woven only with an upper surface side weft is placed between lower warp binding yarns for weaving the upper and lower layers, a space appears in a diagonal direction between lower warp binding yarns, which results in a fabric with excellent breathability and water drainage property. The pair 1 of first binding warps and the pair 2 of second binding warps were so far described, which will be equally applicable to the pair 5 of first binding yarns and pair 6 of second binding yarns.

The lower side surface has a 3/1 design in which it passes over three lower surface side wefts and passes under a lower surface side weft. Lower surface side wefts have a design of passing over a warp on the lower surface side, and passing under three successive warps on the lower surface side to form a weft long crimp on the lower surface side surface. By employing a design of forming a weft long crimp on the lower side surface, a fabric having excellent abrasion resistance can be obtained.

Example 5

Figure 10:
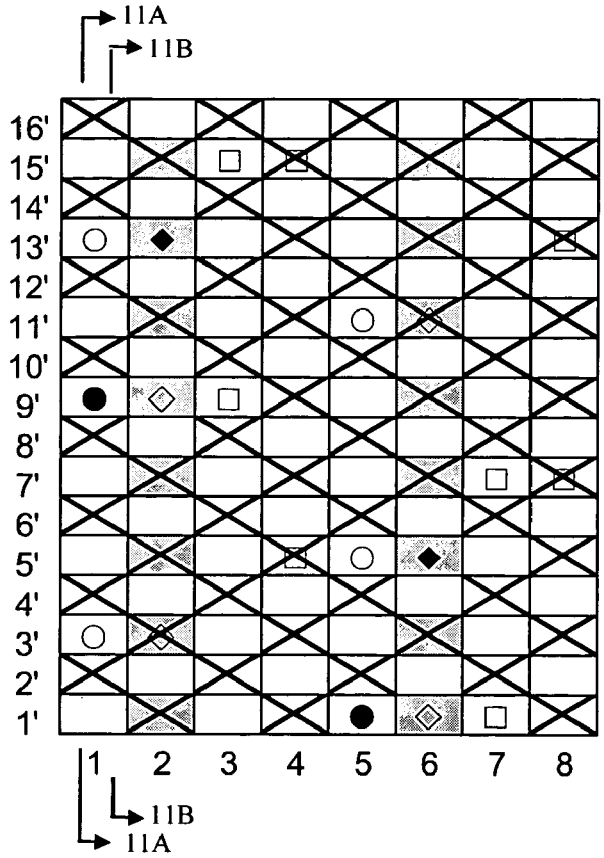
FIG. 10 is a design diagram showing a repeating unit of an industrial two-layer fabric of Example 5 according to the present invention.
Figure 11A:
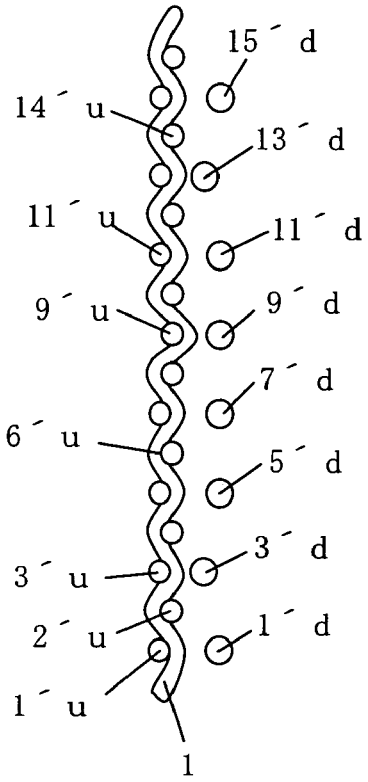
FIGS. 11A and 11B include cross-sectional views taken along the lines 11A-11A and 11B-11B of FIG. 10 showing a pair 1 of first binding warps 1 and a pair 2 of second binding warps in FIG. 10 respectively.
Figure 11B:
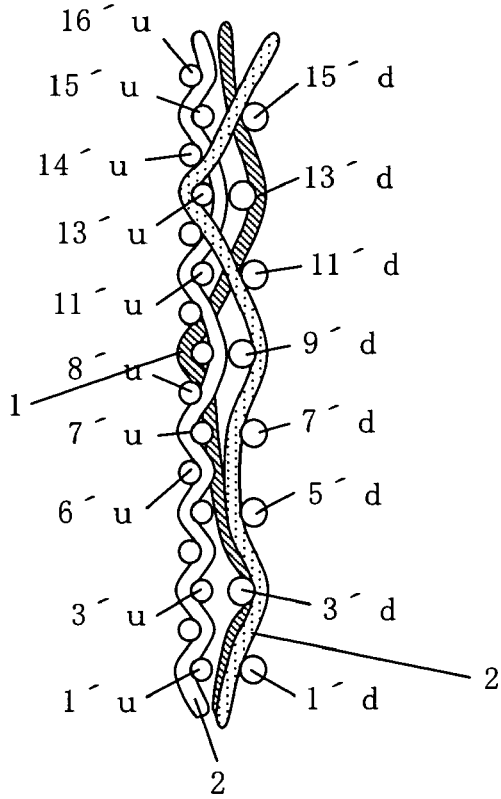

FIG. 10 is a design diagram of a repeating unit of a fabric of Example 5 of the present invention. FIGS. 11A and 11B include cross-sectional views along the liens 11A-11A and 11B-11B of FIG. 10 illustrating a first upper surface side warp 1 (FIG. 11A), and a first lower warp binding yarn 1 (FIG. 11B), a second upper surface side warp 2 and a second lower warp binding yarn 2 (FIG. 11B) illustrated in the design diagram of FIG. 10 respectively.

In the design diagram of FIG. 10, indicated at numerals 1 and 5 are each a pair of first binding warps, 2 and 6 are each a pair of second binding warps, and 3, 4, 7 and 8 are each a pair of warps composed of an upper surface side warp and a lower surface side warp.

The upper side surface has a plain weave design in which a warp alternately passes over and under an upper surface side weft. The first lower warp binding yarn 1, the second upper surface side warp 2 and the second lower warp binding yarn 2 have respectively different designs, but the design formed by them in combination is a 1/1 plain weave design.

The second upper surface side warp 2 has a design of having a latent portion in which it passes between three upper surface side wefts 8'*u*, 9'*u* and 10'*u* and lower surface side wefts and another latent portion in which it passes between three upper surface side wefts 12'*u*, 13'*u* and 14'*u* and lower surface side wefts. In one of the latent portions, the first lower warp binding yarn 1 has a design of passing over the upper surface side weft 9'*u*, while in the other latent portion, the second lower warp binding yarn 2 has a design of passing over the upper surface side weft 13'*u*. Thus, the second upper surface side warp has two short latent portions. In this Example, the first lower warp binding yarn and the second lower warp binding yarn form knuckles respectively at a position not adjacent to the knuckle of the second upper surface side warp in the latent portion. By this design, the first lower warp binding yarn 1, the second upper surface side warp 2 and the second lower warp binding yarn 2 get together without repulsion and the knuckles of the lower warp binding yarns and the knuckle of the second upper surface side warp are arranged on almost the same line. They therefore seem to be only one warp.

At a binding portion in which a lower warp binding yarn passes over an upper surface side weft, the lower warp binding yarn tries to pull the upper surface side weft to the lower side, but in the present invention, at the pulling portion, the second upper surface side warp 2 adjacent to the lower warp binding yarn supports the upper surface side weft from below by passing under the upper surface side weft so that the knuckles have a uniform height without depressed portion.

In addition, since an upper surface side warp to be woven only with an upper surface side weft is placed between lower warp binding yarns for weaving the upper and lower layers, a space appears in a diagonal direction between lower warp binding yarns, which results in a fabric with excellent breathability and water drainage property. The pair 1 of first binding warps and the pair 2 of second binding warps were so far described, which will be equally applicable to the pair 5 of first binding yarns and pair 6 of second binding yarns.

The lower side surface has a similar design to that of Example 1 so that the fabric has excellent abrasion resistance, rigidity and rigidity in the diagonal direction and generation of dehydration marks, sticking of a sheet raw material onto a wire, and loss of fibers or fillers can be prevented.

Example 6

Figure 12:
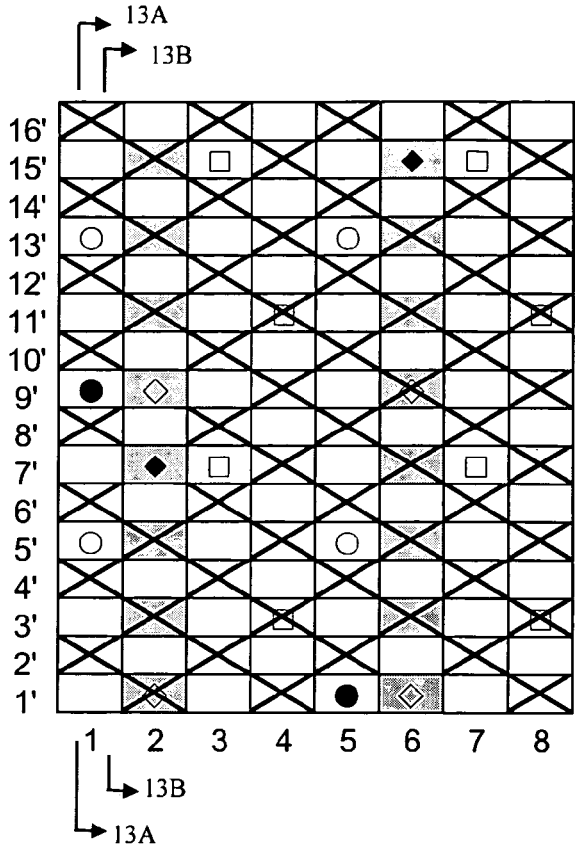
FIG. 12 is a design diagram showing a repeating unit of an industrial two-layer fabric of Example 6 according to the present invention.
Figure 13A:
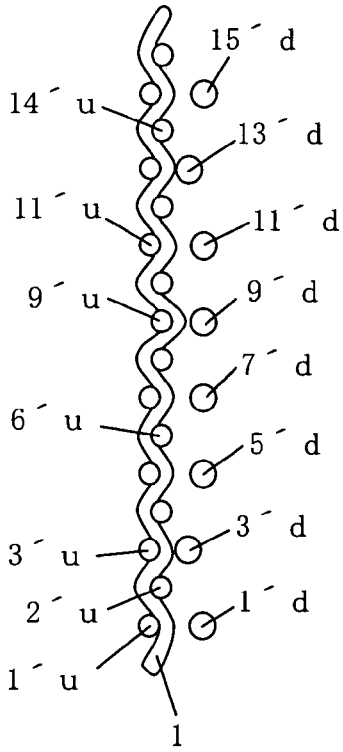
FIGS. 13A and 13B include cross-sectional views taken along the lines 13A-13A and 13B-13B of FIG. 12 showing a pair 1 of first binding warps 1 and a pair 2 of second binding warps in FIG. 12.
Figure 13B:
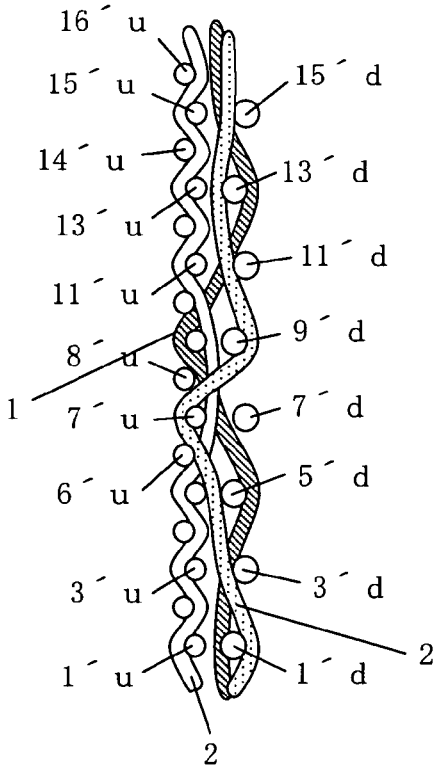

FIG. 12 is a design diagram of a repeating unit of a fabric of Example 6 of the present invention. FIGS. 13A and 13B include cross-sectional views along the lines 13A-13A and 13B-13B of FIG. 12 illustrating a first upper surface side warp 1 (FIG. 13A), and a first lower warp binding yarn 1 (FIG. 13B), a second upper surface side warp 2 and a second lower warp binding yarn 2 (FIG. 13B) illustrated in the design diagram of FIG. 12 respectively.

In the design diagram of FIG. 12, indicated at numerals 1 and 5 are each a pair of first binding warps, 2 and 6 are each a pair of second binding warps, and 3, 4, 7 and 8 are each a pair of warps composed of an upper surface side warp and a lower surface side warp.

The upper side surface has a plain weave design in which a warp alternately passes over and under an upper surface side weft. The first lower warp binding yarn 1, the second upper surface side warp 2 and the second lower warp binding yarn have respectively different designs, but the design formed by them in combination is a 1/1 plain weave design.

The second upper surface side warp 2 has a design of forming a latent portion in which it passes between five upper surface side wefts 6'*u* to 10'*u* and lower surface side wefts. In this latent portion, the first lower warp binding yarn 1 has a design of passing over the upper surface side weft 9'*u*, and the second lower warp binding yarn 2 has a design of passing over the upper surface side weft 7'*u*. Thus, there exists one short latent portion in this Example. In the latent portion, the first lower warp binding yarn and the second lower warp binding yarn form a knuckle at a position not adjacent to the knuckle of the second upper surface side warp. By this design, the first lower warp binding yarn 1, the second upper surface side warp 2 and the second lower warp binding yarn 2 get together without repulsion and the knuckles of lower warp binding yarns and the knuckle of the second upper surface side warp are arranged on almost the same line. They therefore seem to be only one warp. At a binding portion in which a lower warp binding yarn passes over an upper surface side weft, the lower warp binding yarn tries to pull the upper surface side weft toward the lower side, but in the present invention, at the pulling portion, the second upper surface side warp 2 adjacent to the lower warp binding yarn supports the upper surface side weft below by passing under the upper surface side weft so that the knuckles have a uniform height without depressed portion.

In addition, since an upper surface side warp to be woven only with an upper surface side weft is placed between lower warp binding yarns for weaving the upper and lower layers, a space appears in a diagonal direction between lower warp binding yarns, which results in a fabric with excellent breathability and water drainage property. The pair 1 of first binding warps and the pair 2 of second binding warps were so far described, which will be equally applicable to the pair 5 of first binding yarns and pair 6 of second binding yarns.

On the lower side surface, warps on the lower side each has a 3/1 design in which it passes over three lower surface side wefts and passes under a lower surface side weft. Lower surface side wefts have a design in which each weft passes over a warp on the lower surface side and passes under three successive warps on the lower surface side to form a weft long crimp on the lower side surface. By employing such a design of forming a weft long crimp on the lower side surface, the fabric having excellent abrasion resistance can be obtained.

Example 7

Figure 14:
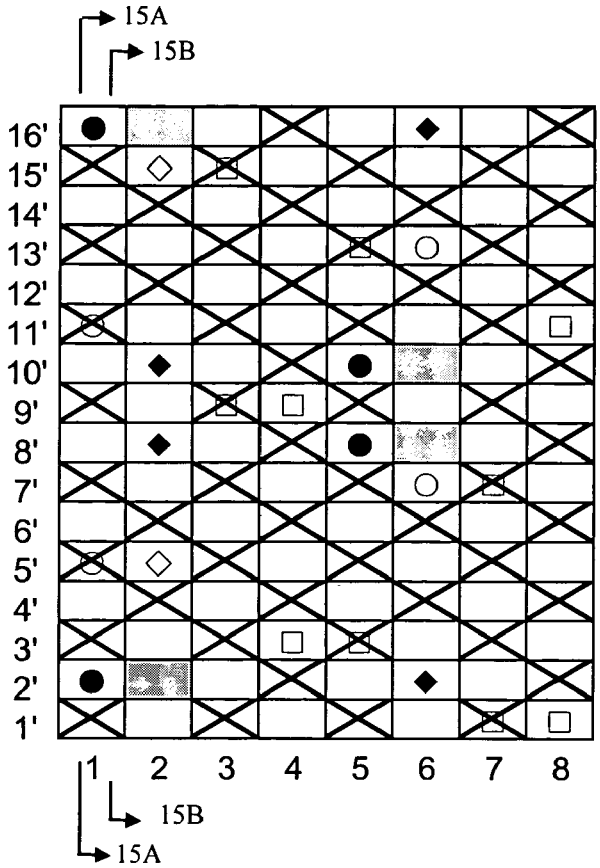
FIG. 14 is a design diagram showing a repeating unit of an industrial two-layer fabric of Example 7 according to the present invention.
Figure 15A:
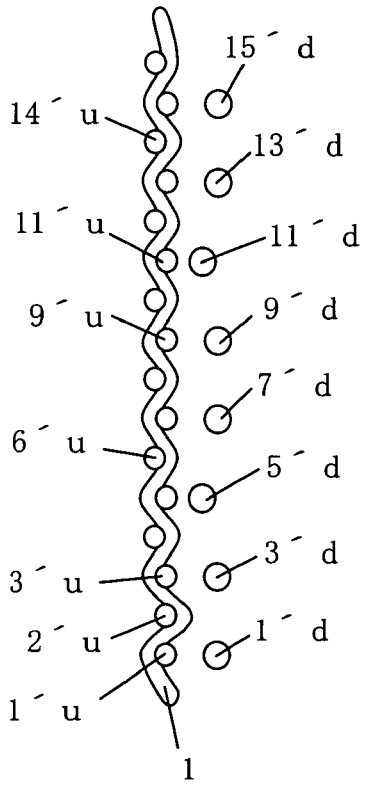
FIGS. 15A and 15B include cross-sectional views taken along the lines 15A-15A and 15B-15B of FIG. 14 showing a pair 1 of first binding warps 1 and a pair 2 of second binding warps in FIG. 14 respectively.
Figure 15B:
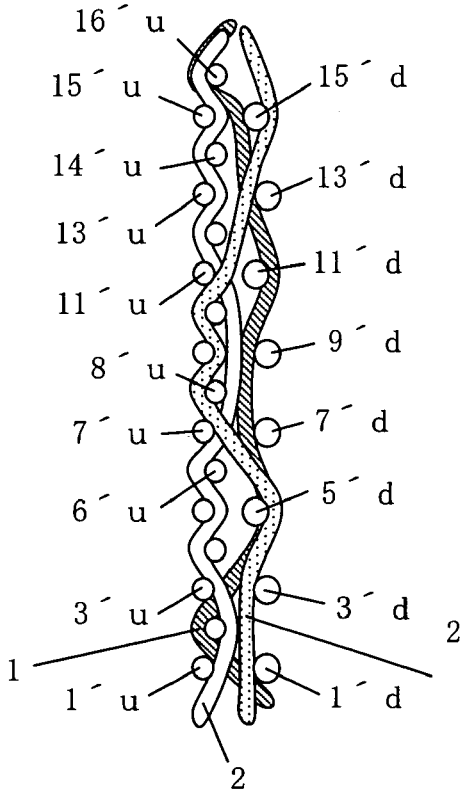

FIG. 14 is a design diagram of a repeating unit of fabric of Example 7 of the present invention. FIGS. 15A and 15B of FIG. 14 includes cross-sectional views illustrating a first upper surface side warp 1 (FIG. 15A), and a first lower warp binding yarn 1 (FIG. 15B), a second upper surface side warp 2 and a second lower warp binding yarn 2 (FIG. 15B) illustrated in the design diagram of FIG. 14 respectively.

In the design diagram of FIG. 14, indicated at numerals 1 and 5 are each a pair of first binding warps, 2 and 6 are each a pair of second binding warps, and 3, 4, 7 and 8 are each a pair of warps composed of an upper surface side warp and a lower surface side warp.

The upper side surface has a 1/1 design in which a warp alternately passes over and under an upper surface side weft. The first lower warp binding yarn 1, the second upper surface side warp 2 and the second lower warp binding yarn have respectively different designs, but the design formed by them in combination is a 1/1 design.

The second upper surface side warp 2 has a design of forming a latent portion in which it passes between five upper surface side wefts 7'*u* to 11'*u* and lower surface side wefts and another latent portion in which it passes between five upper surface side wefts 15'*u*, 16'*u* and 1'*u* to 3'*u* and lower surface side wefts. In one of the latent portions, the first lower warp binding yarn 1 has a design of passing over the upper surface side weft 16'*u* and the upper surface side weft 2'*u*, while in the other latent portion, the second lower warp binding yarn 2 has a design of passing over the upper surface side weft 8'*u* and upper surface side weft 10'*u*. In this Example, the first lower warp binding yarn and the second lower warp binding yarn form knuckles at positions not adjacent to the knuckle of the second upper surface side warp in the latent portions. By this design, the first lower warp binding yarn 1, the second upper surface side warp 2 and the second lower warp binding yarn 2 get together without repulsion and knuckles of lower warp binding yarns and the knuckle of the second upper surface side warp are arranged on almost the same line. They therefore seem to be only one warp.

The lower side surface has a similar design to that of Example 1 so that the fabric has excellent abrasion resistance, rigidity and rigidity in the diagonal direction of the fabric and generation of dehydration marks, sticking of a sheet raw material onto a wire, and loss of fibers or fillers can be prevented.

Example 8

Figure 16:
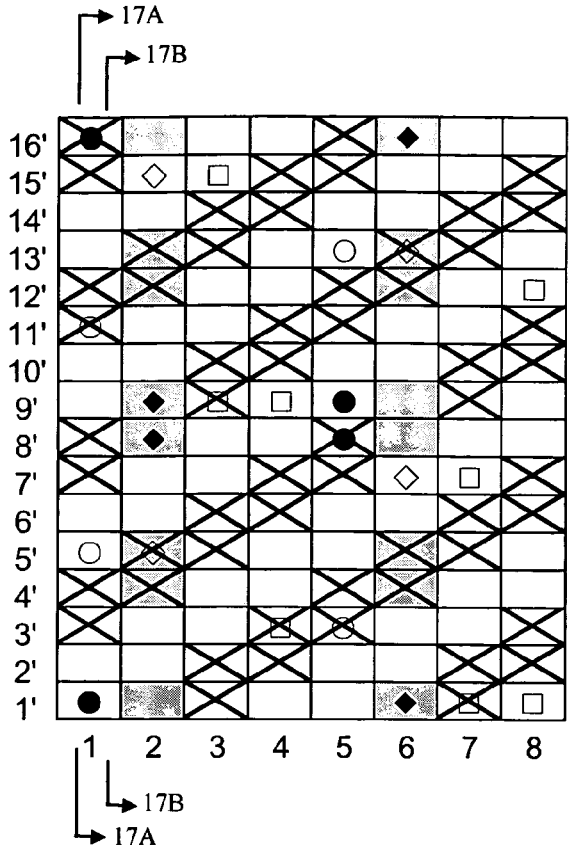
FIG. 16 is a design diagram showing a repeating unit of an industrial two-layer fabric of Example 8 according to the present invention.
Figure 17A:
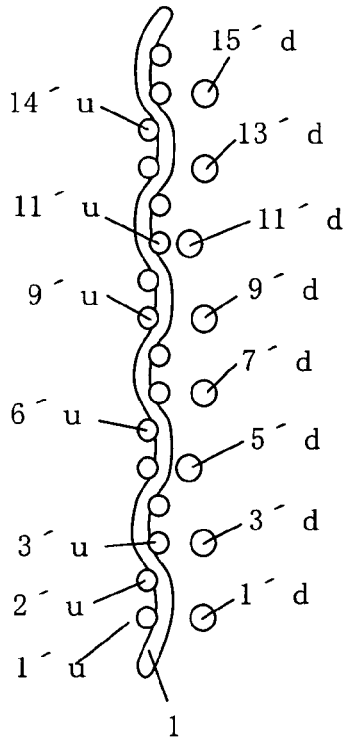
FIGS. 17A and 17B include cross-sectional views taken along the lines 17A-17A and 17B-17B of FIG. 16 showing a pair 1 of first binding warps 1 and a pair 2 of second binding warps in FIG. 16 respectively.
Figure 17B:
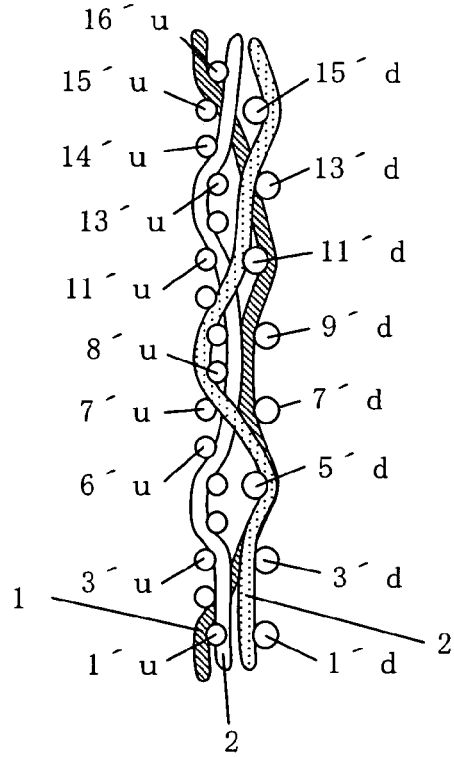

FIG. 16 is a design diagram of a repeating unit of a fabric of Example 8 of the present invention. FIGS. 17A and 17B include cross-sectional views along the lines 17A-17A and 17B-17B of FIG. 16 illustrating a first upper surface side warp 1 (FIG. 17A), and a first lower warp binding yarn 1 (FIG. 17B), a second upper surface side warp 2 and a second lower warp binding yarn 2 (FIG. 17B) illustrated in the design diagram of FIG. 16 respectively.

In the design diagram of FIG. 16, indicated at numerals 1 and 5 are each a pair of first binding warps, 2 and 6 are each a pair of second binding warps, and 3, 4, 7 and 8 are each a pair of warps composed of an upper surface side warp and a lower surface side warp.

The upper side surface has a 2/2 design in which a warp passes over two upper surface side wefts and passes under two upper surface side wefts. The first lower warp binding yarn 1, the second upper surface side warp 2 and the second lower warp binding yarn have respectively different designs, but the design formed by them in combination is a 2/2 design.

The second upper surface side warp 2 has a design of forming a latent portion in which it passes between six upper surface side wefts 6'*u* to 11'*u* and lower surface side wefts and another latent portion in which it passes between six upper surface side wefts 14'*u* to 16'*u* and 1'*u* to 3'*u* and lower surface side wefts. In one of the latent portions, the first lower warp binding yarn 1 has a design of passing over two upper surface side wefts 16'*u* and 1'*u*, while in the other latent portion, the second lower warp binding yarn 2 has a design of passing over two upper surface side weft 8'*u* and 9'*u*. In this Example, the first lower warp binding yarn and the second lower warp binding yarn form knuckles at positions not adjacent to the knuckle of the second upper surface side warp in the latent portions. By this design, the first lower warp binding yarn 1, the second upper surface side warp 2 and the second lower warp binding yarn 2 get together without repulsion and respective knuckles of lower warp binding yarns and the knuckle of the second upper surface side warp are arranged on almost the same line. They therefore seem to form only one warp.

The lower side surface has a similar design to that of Example 1 so that the fabric has excellent abrasion resistance, rigidity and rigidity in the diagonal direction and generation of dehydration marks, sticking of a sheet raw material onto a wire, and loss of fibers or fillers can be prevented.

Example 9

Figure 18:
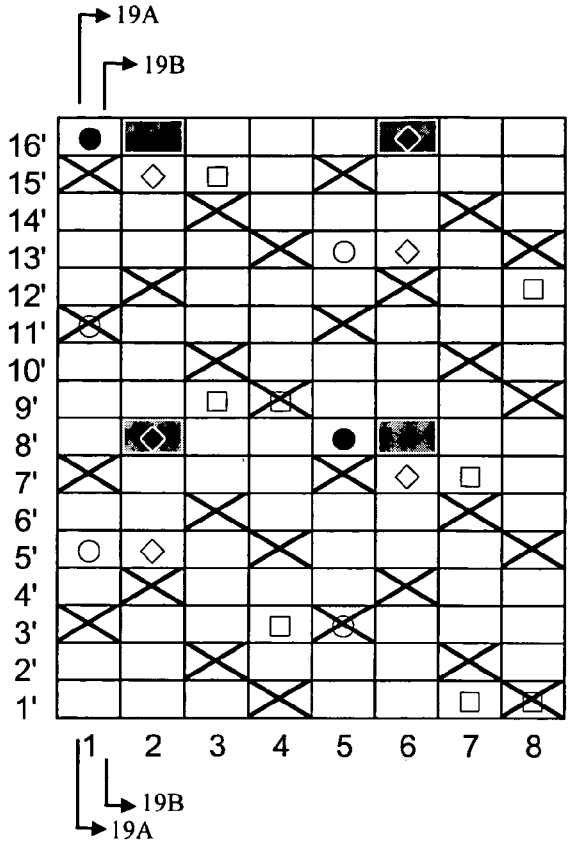
FIG. 18 is a design diagram showing a repeating unit of an industrial two-layer fabric of Example 9 according to the present invention.
Figure 19A:
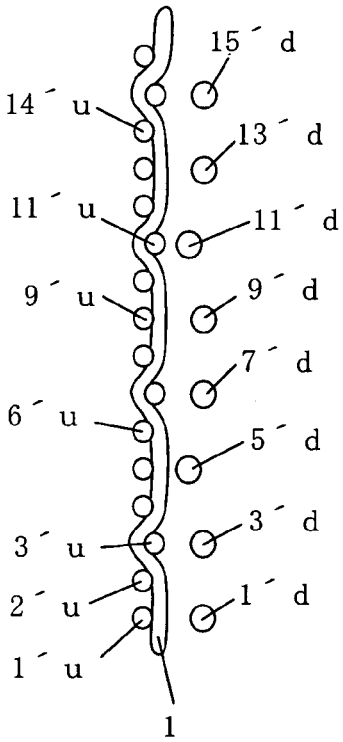
FIGS. 19A and 19B includes cross-sectional views taken along the lines 19A-19A and 19B-19B of FIG. 18 showing a pair 1 of first binding warps 1 and a pair 2 of second binding warps in FIG. 18 respectively.
Figure 19B:
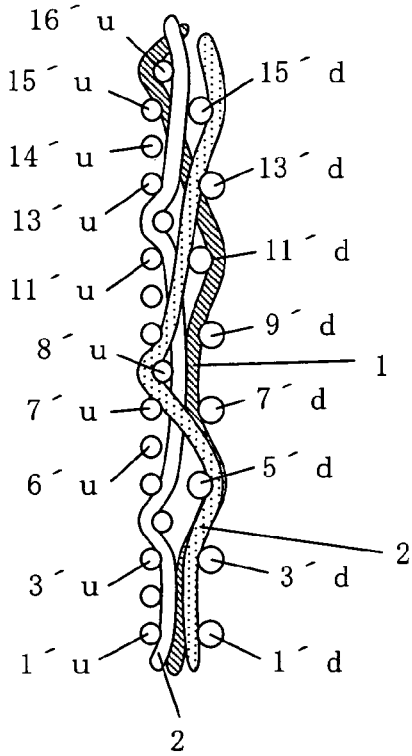

FIG. 18 is a design diagram of a repeating unit of a fabric of Example 9 of the present invention. FIGS. 19A and 19B include cross-sectional views along the lines 19A-19A and 19B-19B of FIG. 18 illustrating a first upper surface side warp 1 (FIG. 19A), and a first lower warp binding yarn 1 (FIG. 19B), a second upper surface side warp 2 and a second lower warp binding yarn 2 (FIG. 19B) illustrated in the design diagram of FIG. 18.

In the design diagram of FIG. 18, indicated at numerals 1 and 5 are each a pair of first binding warps, 2 and 6 are each a pair of second binding warps, and 3, 4, 7 and 8 are each a pair of warps composed of an upper surface side warp and a lower surface side warp.

The upper side surface has a 1/3 design in which a warp passes over an upper surface side weft and passes under three upper surface side wefts. The first lower warp binding yarn 1, the second upper surface side warp 2 and the second lower warp binding yarn have respectively different designs, but the design formed by them in combination is a 1/3 design.

The second upper surface side warp 2 has a design of forming a latent portion in which it passes between seven upper surface side wefts 5'*u* to 11'*u* and lower surface side wefts and another latent portion in which it passes between seven upper surface side wefts 13'*u* to 16'*u* and 1'*u* to 3'*u* and lower surface side wefts. In one of the latent portions, the first lower warp binding yarn 1 has a design of passing over an upper surface side weft 16'*u*, while in the other latent portion, the second lower warp binding yarn 2 has a design of passing over an upper surface side weft 8'*u*. The first lower warp binding yarn and the second lower warp binding yarn form respective knuckles at positions not adjacent to the knuckle of the second upper surface side warp in the latent portions. By this design, the first lower warp binding yarn 1, the second upper surface side warp 2 and the second lower warp binding yarn 2 get together without repulsion and the knuckles of the lower warp binding yarns and the knuckle of the second upper surface side warp are arranged on almost the same line. They therefore seem to be only one warp.

The lower side surface has a similar design to that of Example 1 so that the fabric has excellent abrasion resistance, rigidity and rigidity in the diagonal direction of the fabric and generation of dehydration marks, sticking of a sheet raw material onto a wire, and loss of fibers or fillers can be suppressed.

Example 10

Figure 20:
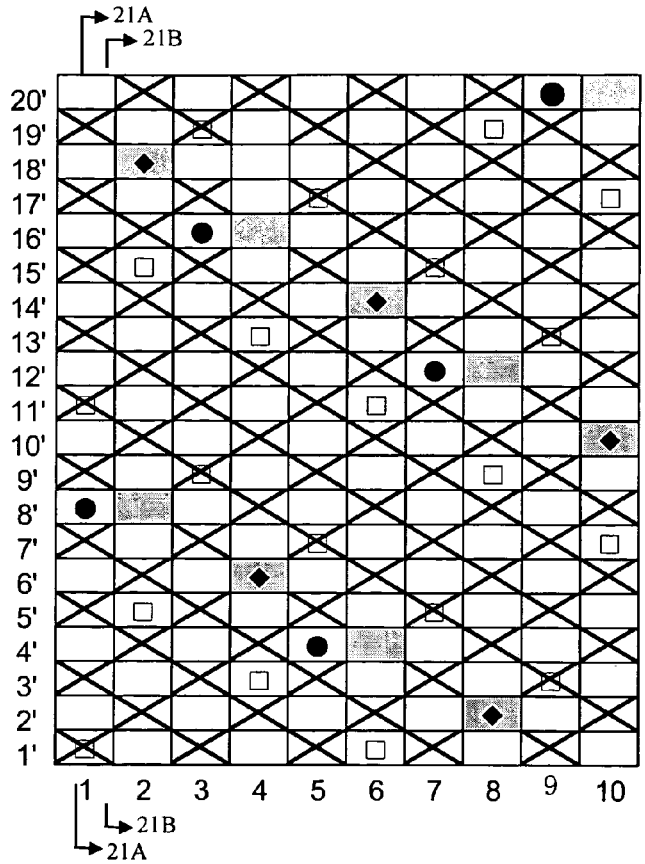
FIG. 20 is a design diagram showing a repeating unit of an industrial two-layer fabric of Example 10 according to the present invention.
Figure 21A:
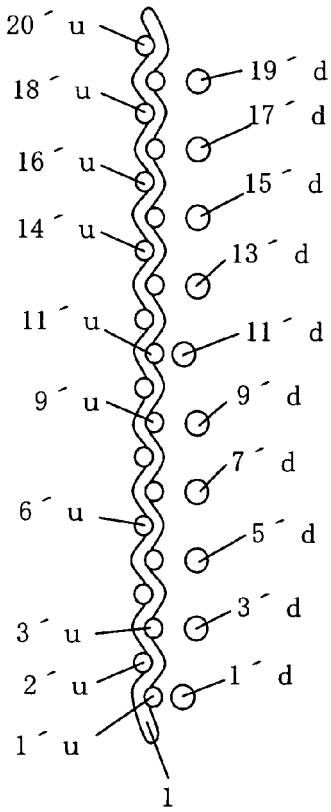
FIGS. 21A and 21B include cross-sectional views taken along the lines 21A-21A and 21B-21B of FIG. 20 showing a pair 1 of first binding warps 1 and a pair 2 of second binding warps in FIG. 20 respectively.
Figure 21B:
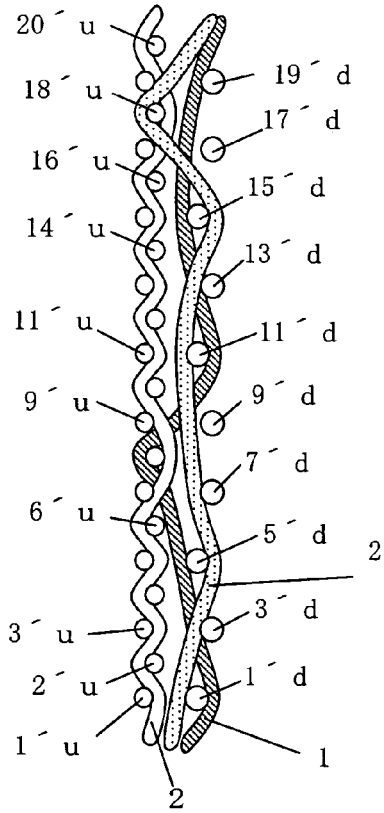

FIG. 20 is a design diagram of a repeating unit of a fabric of Example 10 of the present invention. FIGS. 21A and 21B include cross-sectional views along the lines 21A-21A and 21B-21B of FIG. 20 illustrating a first upper surface side warp 1 (FIG. 21A), and a first lower warp binding yarn 1 (FIG. 21B), a second upper surface side warp 2 and a second lower warp binding yarn 2 (FIG. 21B) illustrated in the design diagram of FIG. 20. The fabric is a 20-shaft two-layer fabric in which ten pairs of binding warps are arranged at a ratio of 10/10. As in this Example, each warp constituting the fabric may be such a pair of binding warps. Upper surface side wefts and lower surface side wefts are arranged at a ratio of 2:1. The fabric of this Example may be either a 16-shaft fabric as in the previous example or a 20-shaft fabric as in this Example.

In the design diagram of FIG. 20, indicated at numerals 1, 3, 5, 7 and 9 are each a pair of first binding warps, while 2, 4, 6, 8 and 10 are each a pair of second binding warps.

The upper side surface has a 1/1 design in which a warp alternately passes over and under an upper surface side weft. The first lower warp binding yarn 1, the second upper surface side warp 2 and the second lower warp binding yarn have respectively different designs, but the design formed by them in combination is a 1/1 design.

The second upper surface side warp 2 has a design of forming a latent portion in which it passes between three upper surface side wefts 7'*u* to 9'*u* and lower surface side wefts and another latent portion in which it passes between three upper surface side wefts 17'*u* to 19'*u* and lower surface side wefts. In one of these latent portions, the first lower warp binding yarn 1 has a design of passing over an upper surface side weft 8'*u*, while in the other latent portion, the second lower warp binding yarn 2 has a design of passing over an upper surface side weft 18'*u*. The first lower warp binding yarn and the second lower warp binding yarn form respective knuckles at positions not adjacent to the knuckle of the second upper surface side warp in the latent portions. By this design, the first lower warp binding yarn 1, the second upper surface side warp 2 and the second lower warp binding yarn 2 get together without repulsion and the knuckles of the lower warp binding yarns and the knuckle of the second upper surface side warp are arranged on almost the same line. They therefore seem to be only one warp.

The lower side surface has a 4/1 design in which a warp on the lower surface side passes over four lower surface side wefts and passes under a lower surface side weft. Lower surface side wefts have a design in which each weft passes over a warp on the lower surface side and passes under four successive warps on the lower surface side to form a weft long crimp on the lower surface side surface. By employing a design of forming a weft long crimp on the lower side surface, the fabric having excellent abrasion resistance can be obtained.

Example 11

Figure 22:
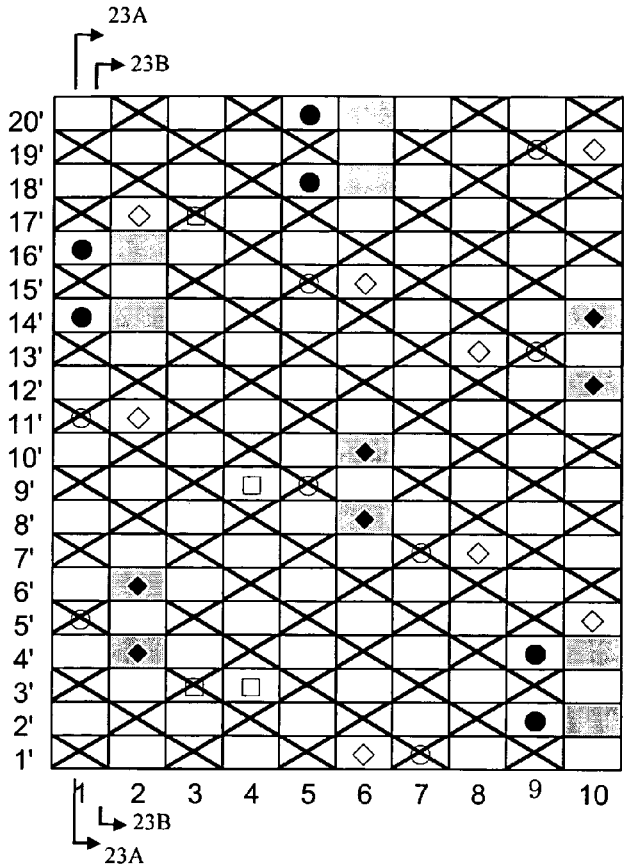
FIG. 22 is a design diagram showing a repeating unit of an industrial two-layer fabric of Example 11 according to the present invention.
Figure 23A:
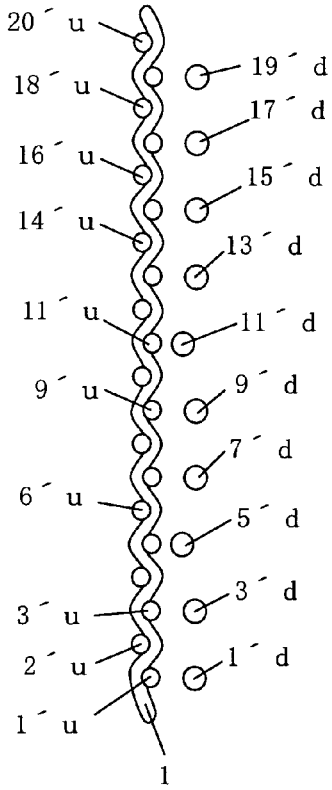
FIGS. 23A and 23B includes cross-sectional views taken along the lines 23A-23A and 23B-23B of FIG. 22 showing a pair 1 of first binding warps 1 and a pair 2 of second binding warps in FIG. 22 respectively.
Figure 23B:
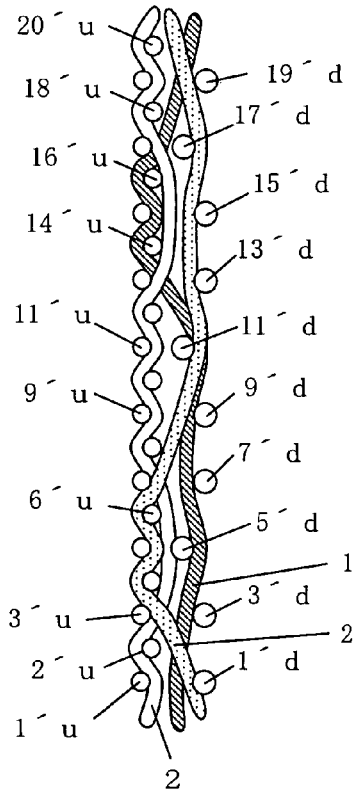

FIG. 22 is a design diagram of a repeating unit of a fabric of Example 11 of the present invention. FIGS. 23A and 23B include cross-sectional views along the lines 23A-23A and 23B-23B illustrating a first upper surface side warp 1 (FIG. 23A), and a first lower warp binding yarn 1 (FIG. 23B), a second upper surface side warp 2 and a second lower warp binding yarn 2 (FIG. 23B) illustrated in the design diagram of FIG. 22 respectively. This fabric has a 20-shaft two-layer fabric in which pairs of binding warps are arranged at a ratio of 6/10. Upper surface side wefts and lower surface side wefts are arranged at a ratio of 2:1.

In the design diagram of FIG. 22, indicated at numerals 1, 5 and 9 are each a pair of first binding warps, and 2, 6 and 10 are each a pair of second binding warps.

The upper side surface has a 1/1 design in which a warp alternately passes over and under an upper surface side weft. The first lower warp binding yarn 1, the second upper surface side warp 2 and the second lower warp binding yarn have respectively different designs, but the design formed by them in combination is a 1/1 design.

The second upper surface side warp 2 has a design of forming a latent portion in which it passes between five upper surface side wefts 3'*u* to 7'*u* and lower surface side wefts and another latent portion in which it passes between five upper surface side wefts 13'*u* to 17'*u* and lower surface side wefts. In one of the latent portions, the first lower warp binding yarn 1 has a design of passing over upper surface side wefts 14'*u* and 16'*u*, while in the other latent portion, the second lower warp binding yarn 2 has a design of passing over upper surface side wefts 4'*u* and 6'*u*. The first lower warp binding yarn and the second lower warp binding yarn form respective knuckles at positions not adjacent to the knuckle of the second upper surface side warp in the latent portions. By this design, the first lower warp binding yarn 1, the second upper surface side warp 2 and the second lower warp binding yarn 2 get together without repulsion and the respective knuckles of the lower warp binding yarns and the knuckle of the second upper surface side warp are arranged on almost the same line. They therefore seem to be only one warp.

The lower side surface has a similar design to that of Example 1 so that the fabric has excellent abrasion resistance, rigidity and rigidity in the diagonal direction of the fabric and generation of dehydration marks, sticking of a sheet raw material onto a wire, and loss of fibers or fillers can be suppressed.

Example 12

Figure 24:
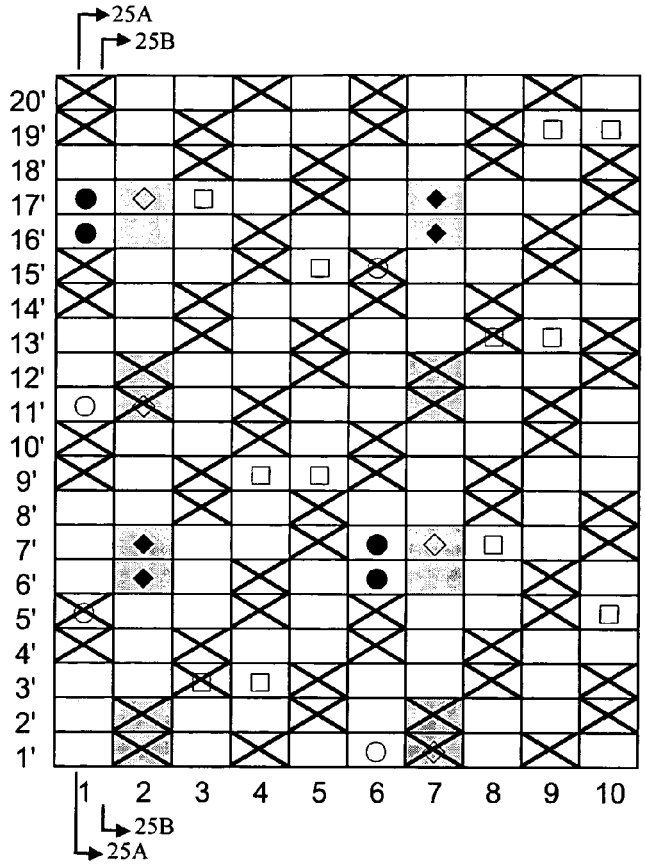
FIG. 24 is a design diagram showing a repeating unit of an industrial two-layer fabric of Example 12 according to the present invention.
Figure 25A:
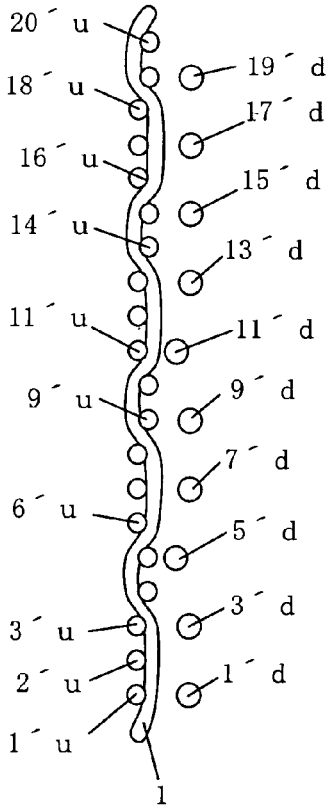
FIGS. 25A and 25B include cross-sectional views taken along the lines 25A-25A and 25B-25B of FIG. 24 showing a pair 1 of a first binding warps 1 and a pair 2 of second binding warps in FIG. 24 respectively.
Figure 25B:
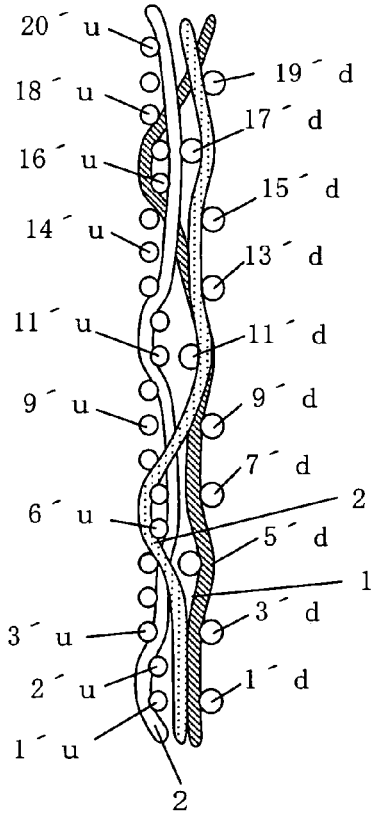

FIG. 24 is a design diagram of a repeating unit of a fabric of Example 12 of the present invention. FIGS. 25A and 25B include cross-sectional views along the lines 25A-25A and 25B-25B of FIG. 24 illustrating a first upper surface side warp 1 (FIG. 25A), and a first lower warp binding yarn 1 (FIG. 25B), a second upper surface side warp 2 and a second lower warp binding yarn 2 (FIG. 25B) illustrated in the design diagram of FIG. 24 respectively. This fabric has a 20-shaft two-layer fabric in which pairs of binding warps are arranged at a ratio of 4/10. Upper surface side wefts and lower surface side wefts are arranged at a ratio of 2:1.

In the design diagram of FIG. 24, indicated at numerals 1 and 6 are each a pair of first binding warps, 2 and 7 are each a pair of second binding warps, and 3, 4, 5, 8, 9 and 10 are each a pair of an upper surface side warp and a lower surface side warp.

The upper side surface has a 2/3 design in which a warp passes over two upper surface side wefts and passes under three upper surface side wefts. The first lower warp binding yarn 1, the second upper surface side warp 2 and the second lower warp binding yarn have respectively different designs, but the design formed by them in combination is a 2/3 design.

The second upper surface side warp 2 has a design of forming a latent portion in which it passes between eight upper surface side wefts 3'*u* to 10'*u* and lower surface side wefts and another latent portion in which it passes between eight upper surface side wefts 13'*u* to 20'*u* and lower surface side wefts. In one of the latent portions, the first lower warp binding yarn 1 has a design of passing over two upper surface side wefts 16'*u* and 17'*u*, while in the other latent portion, the second lower warp binding yarn 2 has a design of passing over two upper surface side wefts 6'*u* and 7'*u*. The first lower warp binding yarn and the second lower warp binding yarn form respective knuckles at positions not adjacent to the knuckle of the second upper surface side warp in the latent portions. By this design, the first lower warp binding yarn 1, the second upper surface side warp 2 and the second lower warp binding yarn 2 get together without repulsion and the respective knuckles of the lower warp binding yarns and the knuckle of the second upper surface side warp are arranged on almost the same line. They therefore seem to be only one warp.

The lower side surface has a similar design to that of Example 1 so that the fabric has excellent abrasion resistance, rigidity and rigidity in the diagonal direction of the fabric and generation of dehydration marks, sticking of a sheet raw material onto a wire, and loss of fibers or fillers can be suppressed.

Example 13

Figure 26:
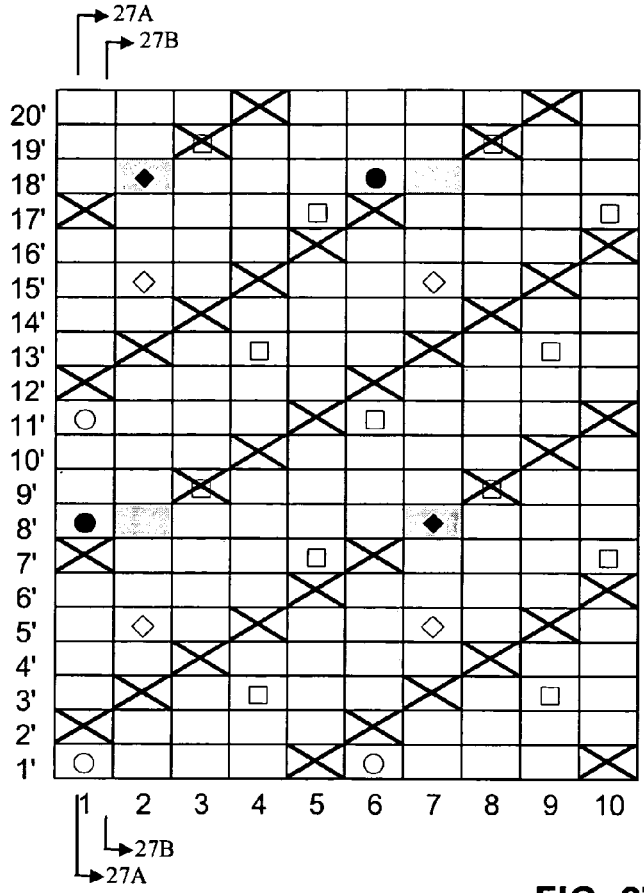
FIG. 26 is a design diagram showing a repeating unit of an industrial two-layer fabric of Example 13 according to the present invention.
Figure 27A:
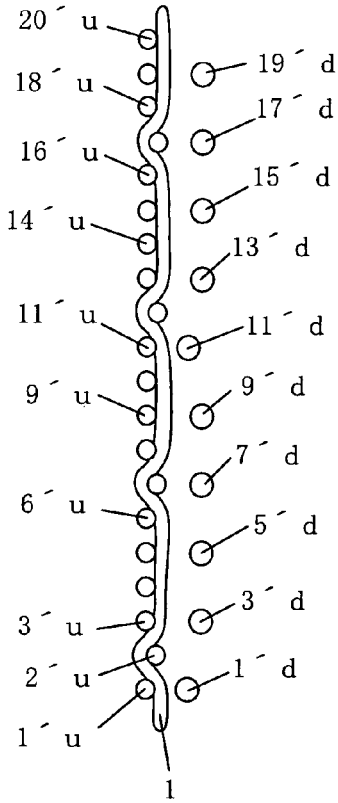
FIGS. 27A and 27B include cross-sectional views taken along the lines 27A-27A and 27B-27B of FIG. 26 showing a pair 1 of first binding warps 1 and a pair 2 of second binding warps in FIG. 26 respectively.
Figure 27B:
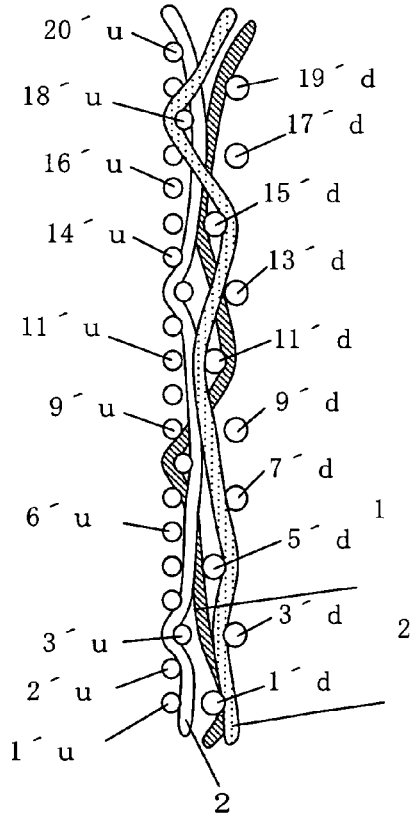

FIG. 26 is a design diagram of a repeating unit of a fabric of Example 13 of the present invention. FIGS. 27A and 27B include cross-sectional views along the lines 27A-27A and 27B-27B of FIG. 26 illustrating a first upper surface side warp 1 (FIG. 27A), and a first lower warp binding yarn 1 (FIG. 27B), a second upper surface side warp 2 and a second lower warp binding yarn 2 (FIG. 27B) illustrated in the design diagram of FIG. 26 respectively. This fabric has a 20-shaft two-layer fabric in which pairs of binding warps are arranged at a ratio of 4/10. Upper surface side wefts and lower surface side wefts are arranged at a ratio of 2:1.

In the design diagram of FIG. 26, indicated at numerals 1 and 6 are each a pair of first binding warps, 2 and 7 are each a pair of second binding warps, and 3, 4, 5, 8, 9 and 10 are each a pair of an upper surface side warp and a lower surface side warp.

The upper side surface has a 1/4 design in which a warp passes over an upper surface side weft and passes under four upper surface side wefts. The first lower warp binding yarn 1, the second upper surface side warp 2 and the second lower warp binding yarn have respectively different designs, but the design formed by them in combination is a 1/4 design.

The second upper surface side warp 2 has a design of forming a latent portion in which the warp 2 passes between nine upper surface side wefts 4'*u* to 12'*u* and lower surface side wefts and another latent portion in which the warp 2 passes between nine upper surface side wefts 14'*u* to 20'*u* and 1'*u* to 2'*u* and lower surface side wefts. In one of the latent portions, the first lower warp binding yarn 1 has a design of passing over an upper surface side weft 8'*u*, while in the other latent portion, the second lower warp binding yarn 2 has a design of passing over an upper surface side weft 18'*u*. The first lower warp binding yarn and the second lower warp binding yarn form respective knuckles at positions not adjacent to the knuckle of the second upper surface side warp in the latent portions. By this design, the first lower warp binding yarn 1, the second upper surface side warp 2 and the second lower warp binding yarn 2 get together without repulsion and the respective knuckles of the lower warp binding yarns and the knuckle of the second upper surface side warp are arranged on almost the same line. They therefore seem to be only one warp.

The lower side surface has a similar design to that of Example 10 so that the fabric has excellent abrasion resistance, rigidity and rigidity in the diagonal direction of the fabric and generation of dehydration marks, sticking of a sheet raw material onto a wire, and loss of fibers or fillers can be suppressed.

The fabric of the present invention does not transfer its wire marks to paper, has excellent breathability, water drainage property, rigidity and abrasion resistance, and can keep conditions necessary for the manufacture of good quality paper for a prolonged period of time until the end of its life span.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

The disclosure of Japanese Patent Application No. 2005-173469 filed Jun. 14, 2005 including specification, drawings and claims is incorporated herein by reference in its entirety.

What is claimed is:

1. A two-layer fabric comprising a first upper surface side warp that is woven by upper surface side wefts, a first lower warp binding yarn that is woven by both the upper surface side wefts and lower surface side wefts, a second upper surface side warp that is woven by the upper surface side wefts and a second lower warp binding yarn that is woven by both the upper surface side wefts and the lower surface side wefts, wherein in a repeating unit:

the first upper surface side warp and the first lower warp binding yarn form a first pair of warps, the second upper surface side warp and the second lower warp binding yarn form a second pair of warps, the first pair of warps and the second pair of warps are arranged adjacent to each other, and the first upper surface side warp, the first lower warp binding yarn, the second upper surface side warp and the second lower warp binding yarn are arranged in this order;

the first upper surface side warp alone forms a first upper surface side warp design;

the second upper surface side warp forms at least one latent portion in which the second upper surface side warp passes between at least three upper surface side wefts and at least one lower surface side weft and between two knuckles, each of which is formed by the second upper surface side warp that passes over one of the upper surface side wefts, the first lower warp binding yarn and the second lower warp binding yarn form a first knuckle and a second knuckle respectively by passing over one or two upper surface side weft or wefts at a position not adjacent to the two knuckles of the second upper surface side warp in the latent portion, wherein the first and second knuckles are formed at different positions; and the first lower warp binding yarn, the second upper surface side warp and the second lower warp binding yarn cooperatively form a second upper surface side warp design similar to the first upper surface side warp design on the upper surface side surface.

2. An industrial two-layer fabric according to claim 1, wherein the first and second knuckles are formed in the same latent portion.

3. An industrial two-layer fabric according to claim 1, wherein in the repeating unit, the second upper surface side warp forms a plurality of the latent portions, wherein the first knuckle is formed in one of the latent portions whereas the second knuckle is formed in another one of the latent portions.

4. An industrial two-layer fabric according to claim 1, wherein a third pair of warps composed of a third upper surface side warp to be woven with upper surface side wefts and a third lower surface side warp to be woven with lower surface side wefts is arranged adjacent to the first and second pairs of warps.

5. An industrial two-layer fabric according to claim 1, wherein the first lower warp binding yarn and the second lower warp binding yarn have different designs.

6. An industrial two-layer fabric according to claim 1, wherein the first lower warp binding yarn and the second lower warp binding yarn have the same design or mirror-image designs.

7. An industrial two-layer fabric according to claim 1, wherein the first and second upper surface side warp designs are each a 1/4-1/2 design in which a warp yarn passes over one upper surface side weft, passes under four successive upper surface side wefts, passes over one upper surface side weft and then passes under two upper surface side wefts.

8. An industrial two-layer fabric according to claim 1, wherein the first and second upper surface side warp designs are each a 1/1 plain weave design in which a warp yarn passes over one upper surface side weft and passes under one upper surface side weft.

9. An industrial two-layer fabric according to claim 1, wherein a lower surface side weft passes over two successive lower surface side warps and/or lower warp binding yarns, and then passes under two or more successive lower surface side warps and/or lower warp binding yarns to form a long crimp of the lower surface side weft on the lower side surface.

10. An industrial two-layer fabric according to claim 1, wherein a lower surface side weft passes over one lower surface side warp and/or one lower warp binding yarn, and then passes under two or more successive lower surface side warps and/or lower warp binding yarns to form a long crimp of the lower surface side weft on the lower side surface.

* * * * *